US006866356B2

(12) United States Patent
Usuda et al.

(10) Patent No.: US 6,866,356 B2
(45) Date of Patent: Mar. 15, 2005

(54) SYSTEM AND METHODS FOR PROVIDING A HEAD DRIVE UNIT

(75) Inventors: Hidenori Usuda, Matsumoto (JP); Yoshiaki Yamada, Shimosuwa-machi (JP)

(73) Assignee: Seiko Epson Corporation, Tokyo (JP)

( * ) Notice: Subject to any disclaimer, the term of this patent is extended or adjusted under 35 U.S.C. 154(b) by 69 days.

(21) Appl. No.: 10/379,579

(22) Filed: Mar. 6, 2003

(65) Prior Publication Data

US 2003/0218646 A1 Nov. 27, 2003

(30) Foreign Application Priority Data

Mar. 6, 2002 (JP) ..... 2002-060711

(51) Int. Cl.[7] ..... B41J 29/38
(52) U.S. Cl. ..... 347/9; 347/10; 347/11
(58) Field of Search ..... 347/9, 10, 11

(56) References Cited

U.S. PATENT DOCUMENTS 6,464,315 B1 * 10/2002 Otokita et al. ..... 347/9
2003/0128264 A1 * 7/2003 Ishikawa et al. ..... 347/102
2003/0214541 A1 * 11/2003 Jun et al. ..... 347/2

* cited by examiner

*Primary Examiner*—Stephen D. Meier
*Assistant Examiner*—Alfred Dudding
(74) *Attorney, Agent, or Firm*—Oliff & Berridge, PLC

(57) ABSTRACT

The present invention provides a head drive unit capable of discharging a required amount of viscous body from a head having a pressure generating element, such as a piezoelectric element, and a method of the same, a droplet discharge unit having the head drive unit, a head drive program, and a device manufacturing method having a process of discharging the viscous body by the method as one of manufacturing processes. In the invention, a driving signal is a signal to be applied to a pressure generating element, such as a piezoelectric element, provided to a head and is generated in synchronization with a clock signal. The driving signal has a period to vary the voltage and a period to hold the voltage. The present invention can vary the rate of change in the voltage of the driving signal per unit time by setting a voltage variation during the period and the number of clocks of the clock signal held in the period as appropriate depending on the rate of deformation of the pressure generating element per unit time.

22 Claims, 18 Drawing Sheets

BM
FE
BM
FE
BM
FE
BM
W

BM
FE
RD
BM
GD
BM
BD
BM
W

BM
RD
BM
GD
BM
BD
BM
W

BM
RD
BM
GD
BM
BD
BM
CR
W

BM
RD
BM
GD
BM
BD
BM
TL
CR
W

BM
RD
PL
BM
GD
PL
BM
BD
PL
BM
CF
CR
W

SYSTEM AND METHODS FOR PROVIDING A HEAD DRIVE UNIT

BACKGROUND OF THE INVENTION

1. Field of Invention

The present invention relates to a head drive unit and a method of the same, a droplet discharge unit, a head drive program, and a device manufacturing method and a device of the same. More particularly, the present invention relates to a head drive unit for driving a head for discharging a viscous body such as a liquid resin having high viscosity and a method thereof, a droplet discharge unit having the head drive unit, a head drive program, and a device manufacturing method including a process of discharging the viscous body by the above-described method, as one of processes, for manufacturing a liquid crystal display, an organic EL (electroluminescence) display, a color filter substrate, a microlens array, an optical element having a coating layer, and other devices and a device of the same.

2. Description of Related Art

While various electronic equipment, such as a computer and portable information equipment, have been developed, liquid crystal displays, particularly, electronic equipment having a color liquid crystal display of high display performance are increasing in number with the development of such electronic equipment. Also, the color liquid crystal displays have high display performance in spite of compact size, thus having an increased use (range). The color liquid crystal displays have a color filter substrate for coloring a display image. Various methods for manufacturing the color filter substrate have been proposed, one of which is a droplet discharge method by which droplets of R (red), G (green), and B (blue) are landed onto the substrate in specific patterns.

A droplet discharge unit that implements such a droplet discharge method includes a plurality of droplet discharge heads for discharging droplets. Each droplet discharge head has a liquid chamber for temporarily storing a liquid supplied from the exterior, a piezoelectric element (such as a piezo-element) serving as a primary drive for pressurizing the liquid in the liquid chamber to discharge it by a fixed amount, and a nozzle plane having nozzles through which droplets from the liquid chamber are discharged. The droplet discharge heads are arranged at equal pitch intervals to constitute a group of heads, wherein the droplet discharge heads discharge droplets while making the head group scan on the substrate along the scanning direction (for example, X direction), thereby making the droplets, R, G, and B, land onto the substrate. On the other hand, the position of the substrate is adjusted in the direction (such as Y direction) perpendicular to the scanning direction by moving a substrate stand.

SUMMARY OF THE INVENTION

When the color filter substrate of the above-described color liquid crystal display is manufactured, a viscous body having a higher viscosity than that of inks for color printers used in ordinary households is frequently used. With color printers used in ordinary households, droplets can be discharged by a necessary amount even when the driving period of time of a piezoelectric element is short (for example, several microseconds) because a low viscosity body, such as a viscous body having a viscosity of about 3.0 (mPa·s) at room temperature (25° C.), has a low viscous resistance. Also, the color printers used in ordinary households are required to perform high-speed printing, and therefore, the head drive units for driving the droplet discharge head are designed to vibrate a piezoelectric element at high speed, in order to achieve high speed printing.

For example, the conventional head drive units have a driving-signal generating section, to which data indicating the variation of the voltage of a driving signal applied to the piezoelectric element for one reference clock and a clock signal specifying the time for varying the voltage of the driving signal are inputted, for generating a driving signal in synchronization with the reference clock in accordance with the data and the clock signal. The reference clock inputted to the driving-signal generating section has a frequency of about 10 MHz, and the data is a digital signal of about 10 bits with a code. The driving-signal generating section generates a rising or falling waveform of the driving signal until the clock signal is inputted, by adding the value of data inputted every time the reference clock is inputted.

In the conventional head drive unit, in order to generate a driving signal having a steep rising or falling waveform, it is recommended that the value of data to be inputted to the driving-signal generating section be larger or smaller. For example, when the maximum or minimum (negative) value of the data is inputted to the driving-signal generating section, a steep rising or falling driving signal can be generated in the time of one cycle of the reference clock. Practically, a delay in response of a D/A converter provided between the driving-signal generating section and the piezoelectric element causes the rising or falling time for the driving signal to be longer than the time of one cycle of the reference clock.

On the other hand, in order to generate a driving signal having a gentle rising or falling waveform, it is recommended that the value of data to be inputted to the driving-signal generating section be smaller and the clock signal be inputted later. For simplicity, it is assumed that the data is a 10-bit digital signal without a code. At that time, the driving signal can take 210=1,024 different values. However, when data of a minimum value is inputted to generate a gentle rising waveform, the voltage of the driving signal varies from the minimum to the maximum by 1,024 clocks of the reference clock. When the reference clock is of 10 MHz, one cycle of time is 0.1 $\mu$s, and therefore, the time required for rising or falling the driving signal can be varied in the range from 0.1 to 102.4 $\mu$s in theory.

However, the droplet discharge unit used for manufacturing of the color filter substrate uses a high viscosity body, as described above. Therefore, the piezoelectric element must be vibrated over a long period of time, in order to discharge necessary droplets. For example, when manufacturing a color filter, it must be vibrated over several milliseconds. Furthermore, when manufacturing a microlens, it must be vibrated for as long as about one second. As described above, the conventional head drive units are designed to vibrate the piezoelectric element at high speed, and can only set the time required for rising or falling to about 102.4 $\mu$s at the longest, thus posing a problem in that the head drive units used in ordinary households cannot simply be applied to head drive units of droplet discharge units for discharging a high viscosity body.

This problem is not a problem that arises only when manufacturing the color filter substrate provided for a liquid crystal display, but also a problem that arises generally in a device manufacturing method having a process of discharging a viscous body as one manufacturing process, such as a case of manufacturing an organic EL (electroluminescence)

display, a case of manufacturing a microlens array of a high-viscosity transparent liquid resin, and a case of forming a coating layer on the surface of an optical element, such as a spectacle lens, using a high-viscous liquid resin.

The present invention has been made in consideration of the above problem. Accordingly, it is an object of the invention to provide a head drive unit capable of discharging a viscous body by a necessary amount from a head having a pressure generating element, such as a piezoelectric element, and a method thereof, a droplet discharge unit having the head drive unit, a head drive program, a device manufacturing method having a process of discharging the viscous body using the above-described method as one of manufacturing process, and a device manufactured using the droplet discharge unit or the device manufacturing method.

In order to solve the above problem, a head drive unit according to the present invention can be head drive unit for discharging a viscous body by operating in synchronization with a reference clock to apply a driving signal to a pressure generating element of a head having the pressure generating element, and thereby deforming the pressure generating element. The head drive unit (30) can include a driving-signal generating device for generating the driving signal in which a first period during which the value varies in synchronization with the reference clock and a second period during which the value is held for a plurality of cycles of the reference clock are repeated when deforming the pressure generating element.

According to the invention, the driving signal to be applied to the pressure generating element is generated by repeating the first period during which the value of the driving signal is varied and the second period during which the value is held. Therefore, both the driving signal of which the value varies gradually in accordance with the variation during the first period and the number of clocks of the reference clock held in the second period and the driving signal of which the value rapidly varies can freely be generated. A significant modification is not required to allow the setting of the variation during the first period and the number of clocks of the reference clock held in the second period. Therefore, the invention can be realized with little increase in cost. As described above, since most of the arrangement of the conventional units can be used to realize the invention, resources can effectively be used by applying the conventional units.

The head drive unit according to the invention is characterized in that the rate of change in the value during the first period and the number of cycles of the reference clock in which the value is held during the second period are set depending on the rate of deformation of the pressure generating element per unit time. According to the invention, since the rate of change in the value during the first period and the number of cycles of the reference clock in which the value is held during the second period are set depending on the rate of deformation of the pressure generating element per unit time, the rate of deformation of the pressure generating element per unit time can freely be controlled.

In order to discharge a required amount of high viscosity body, the viscous body must be discharged at a certain speed after it is gradually taken into the head once. Therefore, the pressure generating element must be controlled so as to be deformed slowly and then restored in a short time. In the invention, both the driving signal of which the value varies gradually depending on the variation during the first period and the number of clocks of the reference clock held in the second period, and the driving signal of which the value varies rapidly can freely be generated. Therefore, it is very preferable for discharging the viscous body.

The head drive unit according to the invention is characterized in that the number of changes of the value in synchronization with the reference clock during the first period and the number of cycles of the reference clock in which the value is held during the second period are set depending on the rate of deformation of the pressure generating element per unit time.

According to the invention, since the number of changes of the value of the driving signal during the first period and the number of cycles of the reference clock in which the value is held during the second period are set depending on the rate of deformation of the pressure generating element per unit time, the rate of deformation of the pressure generating element can be controlled further freely.

The head drive unit according to the invention can include that the pressure generating element has supply units for supplying the pressure generating element with the driving signal, and the number of changes of the value in synchronization with the reference clock during the first period and the number of cycles of the reference clock in which the value is held during the second period are further set in accordance with the following performance of the supply units for the driving signal.

According to the invention, since the number of changes of the value of the driving signal during the first period and the number of cycles of the reference clock in which the value is held during the second period are further set in accordance with the following performance of the supply units for supplying the pressure generating element with the driving signal, a driving signal in consideration of the following performance of the supply units can be generated. Consequently, the pressure generating element can be controlled to obtain more precise deformation.

Preferably, in the head drive unit according to the invention, the rate of deformation of the pressure generating element per unit time is set depending on the viscosity of the viscous body. More preferably, the viscosity of the viscous body is in the range of 10 to 40,000 mPa·s at room temperature (25° C.).

According to the invention, setting the rate of deformation of the pressure generating element per unit time depending on the viscosity of the viscous body allows various controls by which a high viscosity body is deformed over a long time and a low viscosity body is deformed in a short time, thus leading to a very preferable control in discharging a required amount of viscous body.

The head drive unit according to the invention can be characterized in that the pressure generating element includes a piezoelectric oscillator for pressurizing the viscous body by contraction-vibration or deformation-vibration by the application of the driving signal According to the invention, either the head having a piezoelectric oscillator that contraction-oscillates as a pressure generating element or a head having a piezoelectric oscillator that deformation-oscillates as a pressure generating element can be activated, thus allowing application to various units without significant modification of the unit arrangement.

In order to solve the above problem, in a head drive method according to the invention for discharging a viscous body by operating in synchronization with the reference clock to apply the driving signal to the pressure generating element of a head having the pressure generating element, thereby deforming the pressure generating element, the head drive method is characterized by repeating a first step of varying the value of the driving signal in synchronization with the reference clock and a second step of holding the value of the driving signal for a plurality of cycles of the reference clock when deforming the pressure generating element.

According to the invention, since the driving signal is generated by repeating the first step of varying the value of the driving signal to be applied to the pressure generating element and a second step of holding the value, both the driving signal of which the value varies gradually depending the variation in the first step and the number of clocks of the reference clock held in the second step and the driving signal of which the value varies rapidly can freely be generated.

The head drive method according to the invention can be characterized in that the rate of change in the value in the first step and the number of cycles of the reference clock in which the value is held in the second step are set depending on the rate of deformation of the pressure generating element per unit time.

According to the invention, since the rate of change in the value in the first step and the number of cycles of the reference clock in which the value is held in the second step are set depending on the rate of deformation of the pressure generating element per unit time, the rate of deformation of the pressure generating element per unit time can freely be controlled.

In order to discharge a required amount of high viscosity body, the viscous body must gradually be taken into the head once, and then must be discharged at a certain speed. Therefore, it becomes necessary to control the pressure generating element such that it is deformed slowly and is then restored in a short time. In the invention, both the driving signal of which the value varies gradually depending on the variation during the first period and the number of clocks of the reference clock held in the second period, and the driving signal of which the value rapidly varies can freely be generated. Therefore, it is very preferable for discharging the viscous body.

The head drive method according to the invention is characterized in that the number of changes of the value in synchronization with the reference clock in the first step and the number of cycles of the reference clock in which the value is held in the second step are set depending on the rate of deformation of the pressure generating element per unit time.

According to the invention, since the number of changes of the value of the driving signal in the first step and the number of cycles of the reference clock in which the value is held in the second step are set depending on the rate of deformation of the pressure generating element per unit time, the rate of deformation of the pressure generating element can be controlled further freely.

A head drive method according to the invention can be characterized in that the number of changes of the value in synchronization with the reference clock in the first step and the number of cycles of the reference clock in which the value is held in the second step can be further set in accordance with the following performance of the supply units for supplying the pressure generating element with the driving signal, for the driving signal.

According to the invention, since the number of changes of the value of the driving signal in the first step and the number of cycles of the reference clock in which the value is held in the second step are further set in accordance with the following characteristic of the supply units for supplying the pressure generating element with the driving signal, a driving signal in consideration of the following characteristic of the supply units can be generated. Consequently, the pressure generating element can be controlled so as to be deformed more precisely.

Preferably, in the head drive method according to the invention, the rate of deformation of the pressure generating element per unit time is set depending on the viscosity of the viscous body. More preferably, the viscosity of the viscous body is in the range of 10 to 40,000 mPa·s at room temperature (25° C.).

According to the invention, setting the rate of deformation of the pressure generating element per unit time depending on the viscosity of the viscous member allows various controls by which a high viscosity body is deformed over a long time and a low viscosity body is deformed in a short time, thus leading to a very preferable control when discharging a required amount of viscous body.

In order to solve the above problem, the droplet discharge unit according to the invention can include the head drive unit as described above. According to the invention, providing the above-described head drive unit allows a droplet discharge unit to be provided which can discharge a required amount of viscous body without significant modification of unit arrangement.

In order to solve the above problem, a head drive program of the invention can be characterized in that it is a program for performing the head drive method according to either of the above. All or part of the program for realizing the head drive method may be stored in a recording medium that a computer can read, such as a flexible disk, a CD-ROM, a CD-R, a CD-RW, a DVD (a registered trademark), a DVD-R, a DVD-RW, a DVD-RAM, a magneto-optical disk, a streamer, a hard disk, and a memory.

In order to solve the above problem, a device manufacturing method of the present invention can include a process of discharging the viscous body by the head drive method according to either one of the above, as one of device manufacturing processes. According to the invention, since a required amount of various viscous bodies can be discharge, the manufacture of devices with various ranges of specifications is possible.

In order to solve the above problem, the device of the invention is manufactured using the above-described droplet discharge unit or the above-described device manufacturing method. According to the invention, since the device is manufactured using a unit or a method capable of discharging a required amount of various viscous bodies, the manufacture of devices with various ranges of specifications becomes possible.

BRIEF DESCRIPTION OF THE DRAWINGS

The invention will be described with reference to the accompanying drawings, wherein like numerals reference like elements, and wherein.

DETAILED DESCRIPTION OF PREFERRED EMBODIMENTS

Figure 1:
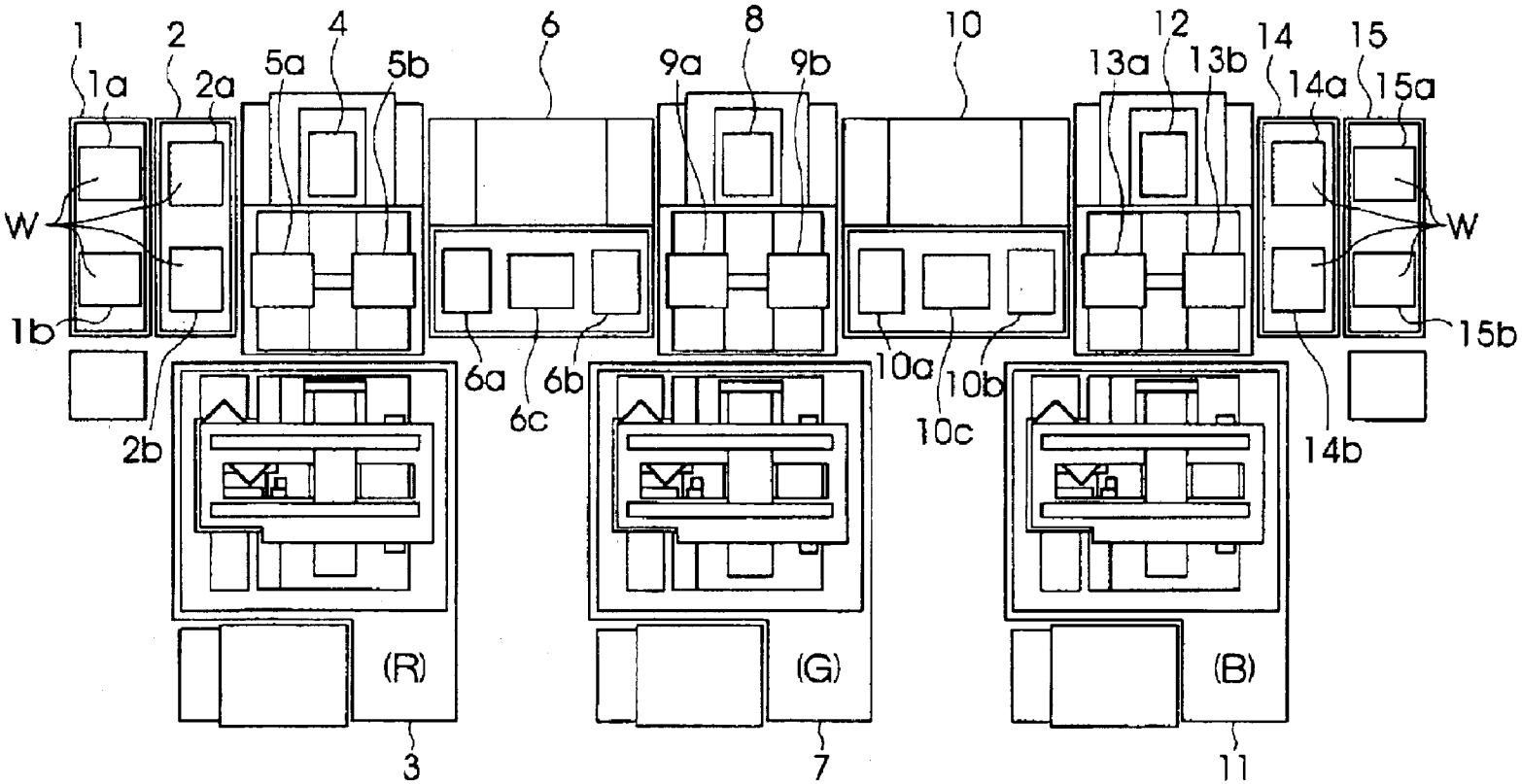
FIG. 1 is a plan view showing the general structure of a device manufacturing apparatus having a droplet discharge unit according an embodiment of the present invention.

Referring to the drawings, a head drive unit and a method thereof, a droplet discharge unit, a head drive program, and a device manufacturing method and a device thereof according to an embodiment of the present invention will be specifically described hereinafter. In the following description, first, examples of a device manufacturing apparatus having a droplet discharge unit and used when manufacturing a device, a device manufactured by using the device manufacturing apparatus, and an example of a device manufacturing method will be discussed. Then, a head drive unit provided to the droplet discharge unit, a head driving method, and a head driving program will be described in sequence.

FIG. 1 is a plan view showing the general structure of a device manufacturing apparatus having a droplet discharge unit according an embodiment of the present invention. As shown in FIG. 1, the device manufacturing apparatus having the droplet discharge unit of this embodiment schematically constructed can include a wafer supply section 1 that holds a substrate (a glass substrate: hereinafter, referred to as a wafer W) to be processed, a wafer turning section 2 that determines the drawing direction of the wafer W transferred from the wafer supply section 1, a droplet discharge unit 3 for landing the droplet of R (red) onto the wafer W transferred from the wafer turning section 2, a baking furnace 4 for drying the wafer W transferred from the droplet discharge unit 3, and robots 5*a* and 5*b* for transferring the wafer W among the units; an intermediate carrying section 6 which determines the cooling and drawing directions of the wafer W transferred from the baking furnace 4 before it is sent to the subsequent process. The device can further include a droplet discharge unit 7 for landing the droplet of G (green) against the wafer W transferred from the intermediate carrying section 6; a baking furnace 8 for drying the wafer W transferred from the droplet discharge unit 7; robots 9*a* and 9*b* for transferring the wafer W among the units, an intermediate carrying section 10 which determines the cooling and drawing directions of the wafer W transferred from the baking furnace 8 before it is sent to the subsequent process, a droplet discharge unit 11 for landing the droplet of B (blue) against the wafer W transferred from the intermediate carrying section 10, a baking furnace 12 for drying the wafer W transferred from the droplet discharge unit 11, robots 13*a* and 13*b* for transferring the wafer W among the units, a wafer turning section 14 which determines the holding direction of the wafer W transferred from the baking furnace 12, and a wafer holding section 15 for holding the wafer W transferred from the wafer turning section 14.

The wafer supply section 1 can include two magazine loaders 1*a* and 1*b* each having an elevator mechanism for holding, for example, 20 sheets of wafers W, vertically, thus allowing sequential supply of the wafers W. The wafer turning section 2 determines the drawing direction in which the wafers W are drawn by the droplet discharge unit 3 and performs temporary positioning before they are transferred to the droplet discharge unit 3 therefrom, wherein two wafer turning tables 2*a* and 2*b* hold the wafers W around the vertical shaft at 90°-pitch intervals accurately and rotatably. Since the details of the droplet discharge units 3, 7, and 11 will be described below, a description thereof will be omitted here.

The baking furnace 4 dries red droplets of the wafers W transferred from the droplet discharge unit 3 by placing the wafers W in a heated environment at, for example, 120° or less for five minutes, thereby allowing preventing problems such as scattering of a red viscous body during the transfer of the wafers W. Robots 5*a* and 5*b* have an arm (not shown) which can be extended and rotated around the base, allowing the wafers W to be transferred among the units smoothly and efficiently by adsorbing the wafers W with a vacuum adsorbing pad mounted at the end of the arm.

The intermediate carrying section 6 includes a cooler 6*a* for cooling the heated wafers W transferred from the baking furnace 4 by the robot 5*b* before they are transferred to the next process, a wafer turning table 6*b* for determining the direction in which the wafers W are drawn by the droplet discharge unit 7 and performing temporary positioning before they are transferred to the droplet discharge unit 7 therefrom, and a buffer 6*c* arranged between the cooler 6*a* and the wafer turning table 6*b* for absorbing the difference in processing speed between the droplet discharge units 3 and 7. The wafer turning table 6*b* can turn the wafers W around the vertical shaft at a 90° or 180° pitch.

The baking furnace 10 is a heating furnace having the same structure as the above-mentioned baking furnace 6, which dries green droplets of the wafers W transferred from the droplet discharge unit 7 by placing the wafers W in a heated environment at, for example, 120° or less for five minutes, thereby allowing preventing problems such as scattering of a green viscous body during the transfer of the wafers W. The robots 9*a* and 9*b* have the same structure as the robots 5*a* and 5*b*, and have an arm (not shown) which can be extended and rotated around the base, allowing the wafers W to be transferred among the units smoothly and efficiently by adsorbing the wafers W with a vacuum adsorbing pad mounted at the end of the arm.

The intermediate carrying section 10 has the same structure as the intermediate carrying section 6, and includes a cooler 10*a* for cooling the heated wafers W transferred from the baking furnace 8 by the robot 9*b* before they are transferred to the next process, a wafer turning table 10*b* for determining the direction in which the wafers W are drawn by the droplet discharge unit 11 and performing temporary positioning before they are transferred to the droplet discharge unit 11 therefrom, and a buffer 10*c* arranged between the cooler 10*a* and the wafer turning table 10*b* for absorbing the difference in processing speed between the droplet discharge units 7 and 11. The wafer turning table 10*b* can turn the wafers W around the vertical shaft at a 90° or 180° pitch.

The wafer turning table 14 can position the turning position such that each of the wafers W after the R, G, and B patterns have been formed by the droplet discharge unit 3, 7, and 11, respectively, is directed to a fixed direction. In other words, the wafer turning table 14 has two wafer turning tables 14*a* and 14*b*, thereby accurately holding the wafers W around the vertical shaft at 90° pitch intervals. The wafer holding section 15 has two magazine unloaders 15*a* and 15*b* each having an elevator mechanism for vertically holding, for example, 20 sheets of finished wafers W (color filter substrates) transferred from the wafer turning table 14, thus allowing sequential holding of the wafers W.

Figures 2A, 2B, 2C, 2D, 2E, 2F:
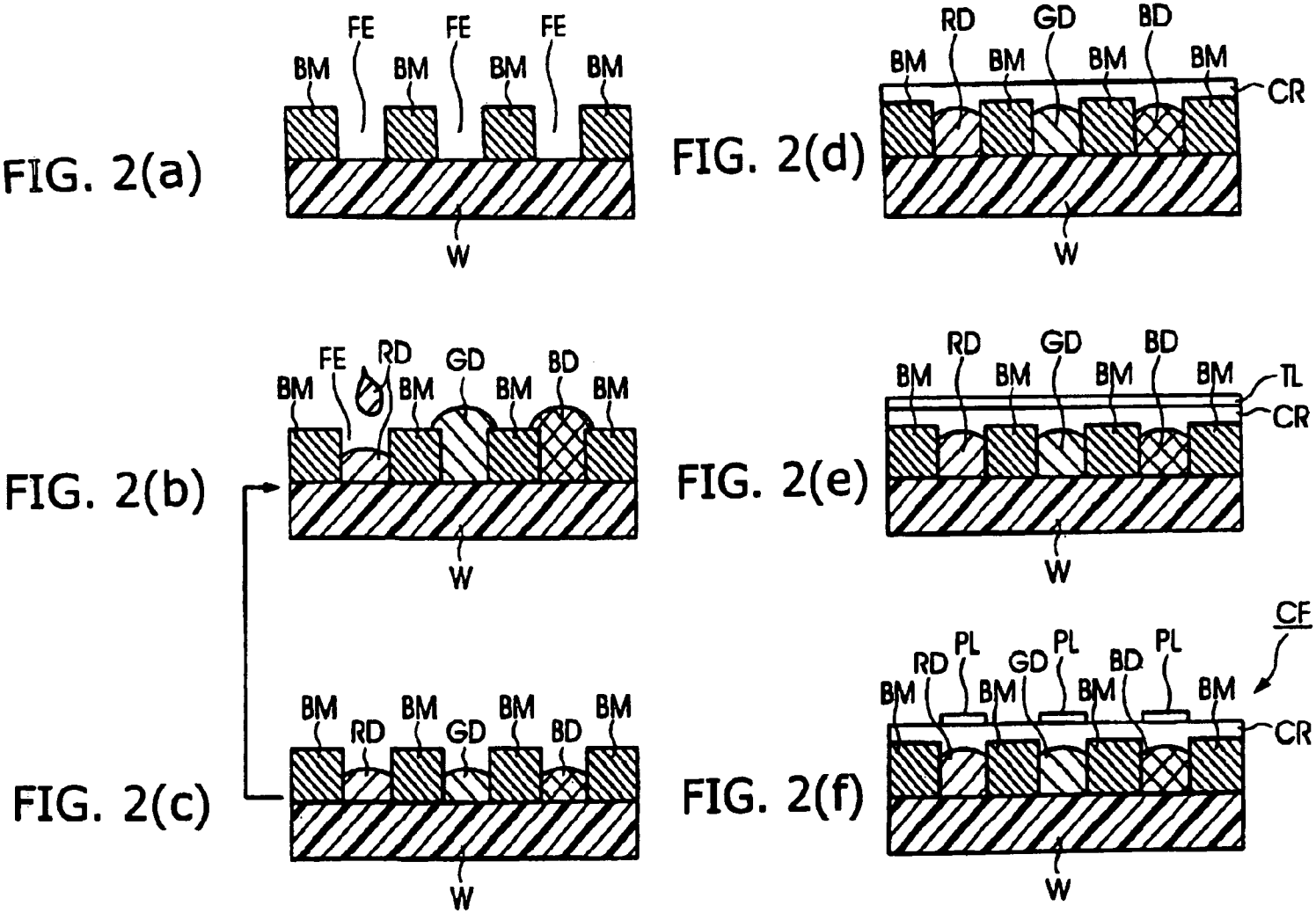
FIGS. 2(*a*)–2(*f*) are diagrams showing a series of manufacturing processes of a color filter substrate, including a process of forming an RGB pattern using the device manufacturing apparatus.

A device manufacturing method according to an embodiment of the present invention and an example of a device manufactured by the manufacturing method will be described hereinafter. In the following description, a method for manufacturing a color filter substrate using the above-mentioned device manufacturing apparatus will be described as an example. FIG. 2 is a diagram showing a series of manufacturing processes of a color filter substrate, including a process of forming an RGB pattern using the device manufacturing apparatus.

The wafer W used for manufacturing the color filter substrate is, for example, a transparent substrate shaped like a rectangular thin plate, having an appropriate mechanical strength and a high light-transmittance property. For example, a transparent glass substrate, acrylic glass, a plastic substrate, a plastic film, and a surface treated product thereof are preferably used as the wafer W. The wafer W has a plurality of color filter areas formed in matrix form in the upstream process of the RGB-pattern forming process, in view of increasing productivity. The color filter area is cut off in the downstream process of the RGB-pattern forming process, thus being used as a color filter substrate suitable for a liquid crystal display.

Figure 3A:
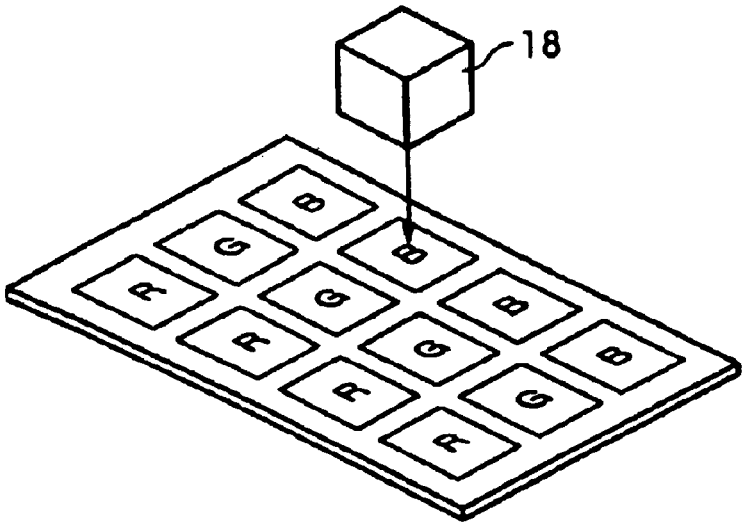
FIGS. 3(*a*)–3(*c*) are diagrams showing examples of RGB patterns formed by the droplet discharge units of the device manufacturing apparatus, wherein (a) is a perspective view showing a stripe pattern, (b) is a partially enlarged view showing a mosaic pattern, and (c) is a partially enlarged view showing a delta pattern.
Figure 3B:
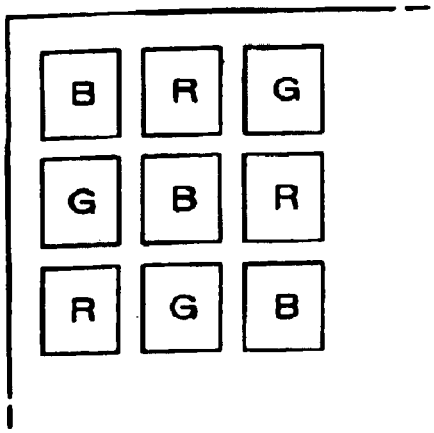
Figure 3C:
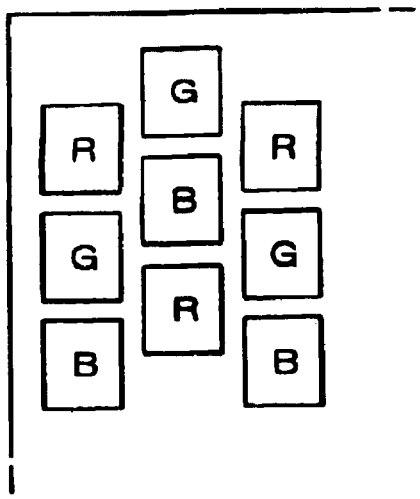

Here, FIG. 3 includes diagrams showing examples of RGB patterns formed by the droplet discharge units of the device manufacturing apparatus, wherein (a) is a perspective view showing a stripe pattern, (b) is a partially enlarged view showing a mosaic pattern, and (c) is a partially enlarged view showing a delta pattern. As shown in FIG. 3, each color filter area has an R (red) viscous body, a G (green) viscous body, and a B (blue) viscous body formed in prescribed patterns by a droplet discharge head 18, which will be described later. The formed patterns include a mosaic pattern shown in FIG. 3(*b*) and a delta pattern shown in FIG. 3(*c*) in addition to a stripe pattern shown in FIG. 3(*a*), however, it should be understood that the formed patterns are not particularly limited in the present invention.

Returning to FIG. 2, in an upstream black-matrix forming process, a (preferably, black) resin without light transmittance is applied to one surface (serving as a foundation of the color filter substrate) of a transparent wafer W in a prescribed thickness (for example, about 2 $\mu$m) by spin coating or the like, as shown in FIG. 2(*a*), and a black matrix BM is then formed in matrix form by photolithography or the like. A minimum display element surrounded by the lattice of the black matrix BM is a so-called filter element FE, which is a window having a width of 30 $\mu$m in one direction (for example, in the direction of X-axis) in the plane of the wafer W and a length of about 100 $\mu$m in the direction (for example, in the direction of Y-axis) perpendicular to that direction. After the black matrix BM has been formed on the wafer W, the resin on the wafer W is baked by heating a heater (not shown).

The wafers W, on which the black matrix BM is formed, are each held in the magazine loaders 1*a* and 1*b* of the wafer supply section 1, as shown in FIG. 1 and are then subjected to the RGB-pattern forming process. In the RGB-pattern forming process, the wafer W held in either one of the magazine loaders 1*a* and 1*b* is adsorbed by the arm of the robot 5*a*, and is then placed either one of the wafer turning tables 2*a* and 2*b*. The wafer turning tables 2*a* and 2*b* determine the drawing direction and the position as a preparation to land red droplets.

Subsequently, the robot 5*a* adsorbs the wafers W on the wafer turning tables 2*a* and 2*b* again and then transfers them to the droplet discharge unit 3. The droplet discharge unit 3 lands red droplets RD in the filter elements FE in position to form a prescribed pattern, as shown in FIG. 2(*b*). The amount of each droplet RD is enough in consideration of a decrease in the volume of the droplet RD in the heating process.

The wafer W, after all the predetermined filter elements FE have been filled with the red droplets RD, is dried at a fixed temperature (for example, about 70°). At that time, evaporation of the solvent of each droplet RD would decrease the volume of the droplet RD, as shown in FIG. 2(*c*). Accordingly, when a large volume is decreased, the landing operation and the drying operation of the droplet RD are repeated until an enough thickness of the viscous body for a color filter substrate is obtained. The solvent of the droplet RD is evaporated by this process, so that only the solid contents of the droplet RD remain finally to form a film.

The drying operation in the red-pattern forming process is performed by the baking furnace 4 shown in FIG. 1. The dried wafer W is in a heated state, and therefore, it is carried to the cooler 6*a* by the robot 5*b* shown in the same drawing and is then cooled. The cooled wafer W is temporarily stored in the buffer 6*c* for timing, and is then transferred to the wafer turning table 6*b* to determine the drawing direction and the position as a preparation to land green droplets hereafter. After having adsorbed the wafer W on the wafer turning table 6*b*, the robot 9*a* transfers it to the droplet discharge unit 7.

The droplet discharge unit 7 lands green droplets GD in the filter element FE in position to form a prescribed pattern, as shown in FIG. 2(*b*). The amount of each droplet GD is enough in consideration of a decrease in the volume of the droplet GD in the heating process. The wafer W after all the predetermined filter elements FE have been filled with the green droplets GD is dried at a fixed temperature (for example, about 70°). At that time, evaporation of the solvent of each droplet GD would decrease the volume of the droplet GD, as shown in FIG. 2(*c*). Accordingly, when a large volume is decreased, the landing operation and the drying operation of the droplet GD are repeated until an enough thickness of the viscous body for a color filter substrate is obtained. The solvent of the droplet GD is evaporated by this process, so that only the solid contents of the droplet GD remain finally to form a film.

The drying operation in the green-pattern forming process is performed by the baking furnace 8 shown in FIG. 1. The dried wafer W is in a heated state, and therefore, it is carried to the cooler 10*a* by the robot 9*b* shown in the same drawing and is then cooled. The cooled wafer W is temporarily stored in the buffer 10*c* for timing, and is then transferred to the wafer turning table 10*b* to determine the drawing direction and the position as a preparation to land blue droplets hereafter. After having adsorbed the wafer W on the wafer turning table 10*b*, the robot 13*a* transfers it to the droplet discharge unit 11.

The droplet discharge unit 11 lands blue droplets BD in the filter element FE in position to form a prescribed pattern, as shown in FIG. 2(*b*). The amount of each droplet BD is enough in consideration of a decrease in the volume of the droplet BD in the heating process. The wafer W after all the predetermined filter elements FE have been filled with the blue droplets BD is dried at a fixed temperature (for example, about 70°), as shown in FIG. 2(*c*). At that time, evaporation of the solvent of each droplet BD would decrease the volume of the droplet BD. Accordingly, when a large volume is decreased, the landing operation and the drying operation of the droplet BD are repeated until an enough thickness of the viscous body for a color filter substrate is obtained. The solvent of the droplet BD is evaporated by this process, so that only the solid contents of the droplet BD remain finally to form a film.

The drying operation in the blue-pattern forming process is performed by the baking furnace 12 shown in FIG. 1. The dried wafer W is transferred to either one of the wafer turning tables 14*a* and 14*b* by the robot 13, and is rotated to be positioned in a fixed direction. The positioned wafer W is held in either one of the magazine unloaders 15*a* and 15*b* by the robot 13*b*. In this manner, the RGB-pattern forming process is completed. Thereafter, the downstream process shown in FIG. 2(*d*) and after is performed.

In a protective film forming process which is one of the downstream processes, shown in FIG. 2(*d*), the droplets RD, GD, and BD are heated at a prescribed temperature for a fixed time to be dried completely. After the drying is completed, a protective film CR is formed for the purpose of protecting and planarizing the surface of the wafer W having a viscous film. The protective film CR is formed by a spin coating method, a roll coating method, a ripping method, or the like. In a transparent electrode forming process, shown in FIG. 2(*e*), subsequent to the protective film forming process, a transparent electrode TL is formed to cover the entire surface of the protective film CR by a spattering method, a vacuum adsorbing method, or the like. In a patterning method, shown in FIG. 2(*f*), subsequent to the transparent electrode forming process, the transparent electrode TL is patterned as a picture electrode PL. When a switching element, such as a TFT (thin film transistor), is used to activate a liquid crystal display panel, the patterning process is not required. Through the above-described processes, a color filter substrate CF shown in FIG. 2(*f*) is produced.

Figure 4:
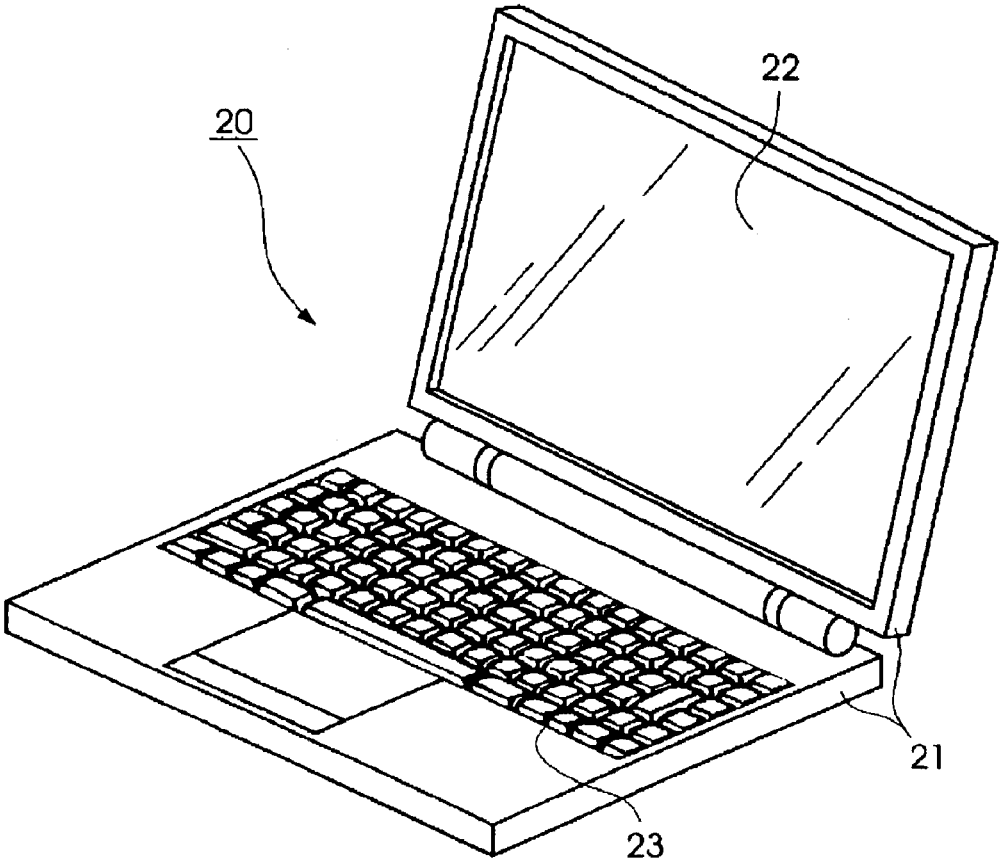
FIG. 4 is a diagram showing an example of a device manufactured by a device manufacturing method according to the embodiment of the invention.

The color filter substrate CF and an opposite substrate (not shown) are arranged to face each other. Then, a liquid crystal is sandwiched therebetween, and a liquid crystal display is thereby manufactured. Electronic parts such as the liquid crystal display manufactured in this way, a mother board having a CPU (central processing unit) and so on, a keyboard, and a hard disk are assembled in a casing to produce a notebook personal computer 20 (device), shown in FIG. 4. FIG. 4 is a diagram showing an example of devices manufactured by a device manufacturing method according to an embodiment of the invention. In FIG. 4, reference numeral 21 denotes a casing, numeral 22 denotes a liquid crystal display, and numeral 23 indicates a keyboard.

It should be understood that the device having the color filter substrate CF formed through the above-described manufacturing process is not limited to the notebook personal computer 20, and that the device may be used in various electronic devices, such as a portable telephone, an electronic databook, a pager, a POS terminal, an IC card, a mini-disc player, a liquid crystal projector, an engineering workstation (EWS), a word processor, a television, a viewfinder or monitor-direct-view video recorder, an electronic desk calculator, a car navigation system, a touch-panel device, a clock, and a game console. Furthermore, the device manufactured by the manufacturing method and using the droplet discharge unit of this embodiment is not limited to the color filter substrate CF, but may be other devices including an organic EL (electroluminescence) display, a microlens array, an optical element such as a spectacle lens having a coating layer thereon.

Figure 5:
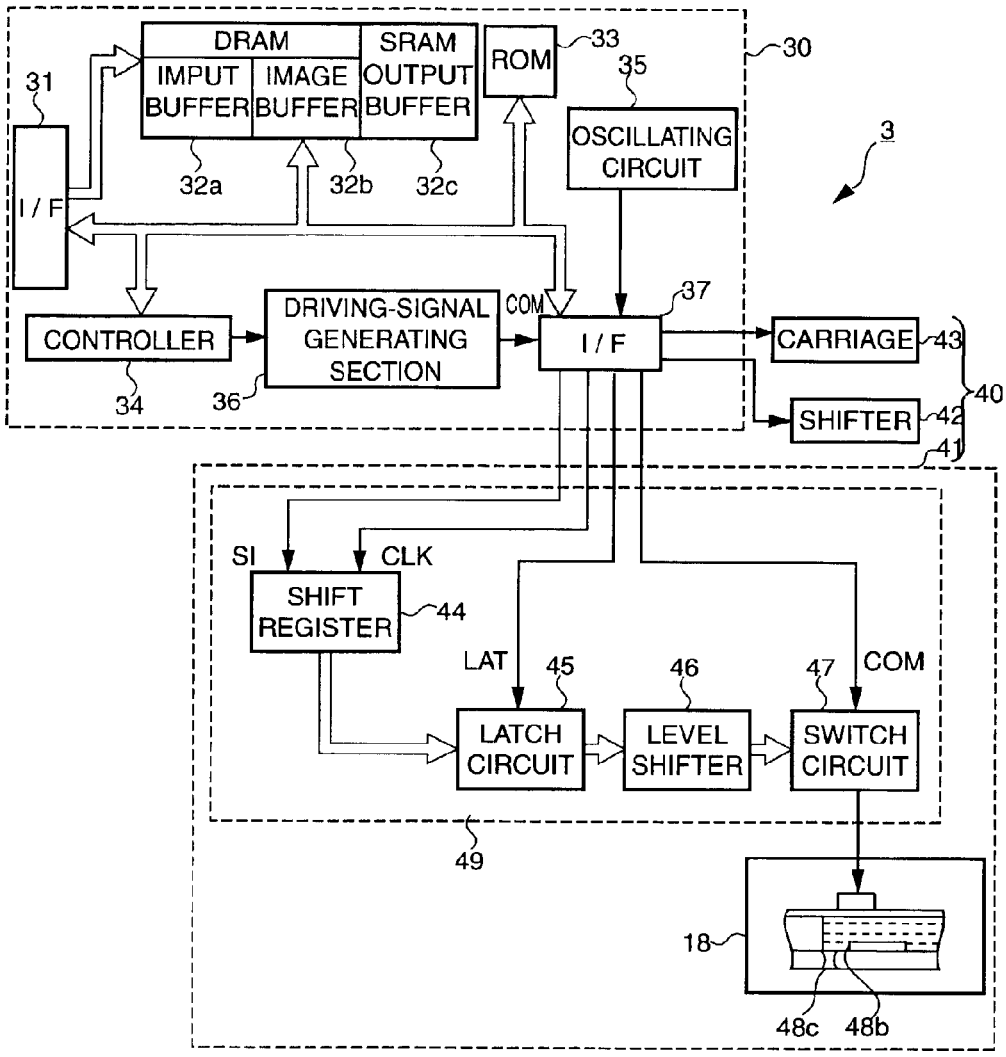
FIG. 5 is an exemplary block diagram showing an electric arrangement of the droplet discharge unit and a head drive unit according to the embodiment of the invention.

The electrical arrangement of the droplet discharge unit and the head drive unit according to the embodiment of the invention will be described. FIG. 5 is an exemplary block diagram showing the electrical arrangement of the droplet discharge unit and the head drive unit according to an embodiment of the invention. Since the droplet discharge units 3, 7, and 11 shown in FIG. 1 have the same arrangement, the droplet discharge unit 3 will be described as an example.

In FIG. 5, the droplet discharge unit 3 has a print controller 30 and a print engine 40. The print engine 40 has a recording head 41, a shifter 42, and a carriage mechanism 43. The shifter 42 performs subscanning by moving a table for the substrate of the wafers W and so on used to manufacture the color filter substrate. The carriage mechanism 43 makes the recording head 41 perform main scanning.

The print controller 30 has an interface 31 for receiving image data (record information) including a multilevel gray-scale information from a computer (not shown), an input buffer 32*a* having a DRAM (dynamic random access memory) for storing various data, such as record information, including the multilevel gray-scale information, an image buffer 32*b*, an output buffer 32*c* having an SRAM (static random access memory), an ROM (read only memory) 33 in which a program and so on for data processing are stored, a controller 34 including a CPU and a memory, an oscillating circuit 35, a driving-signal generating section 36 for generating a driving-signal COM to the recording head 41, and an interface 37 for outputting print data expanded to dot pattern data and a driving signal.

The arrangement of the recording head 41 will then be described. The recording head 41 discharges droplets from each nozzle opening 48*c* of the droplet discharge head at a fixed timing in accordance with the print data and driving signal COM outputted from the print controller 30, having a plurality of nozzle opening 48*c*, a plurality of pressure generating chambers 48*b* each communicating with each of the nozzle openings 48*c*, and a plurality of pressure generating elements 48*a* for discharging droplets through the nozzle openings 48*c* by applying pressure to the viscous body in each pressure generating chamber 48*b*. The recording head 41 has a head drive circuit 49 including a shift register 44, a latch circuit 45, a level shifter 46, and a switch circuit 47.

The general operation when the droplet discharge unit with the above-described arrangement discharges droplets will now be described. Record data SI expanded to dot pattern data in the print controller 30 is serially outputted to the head drive circuit 49 of the recording head 41 through the interface 37 in synchronization with a clock signal CLK from the oscillating circuit 35, and is serially transferred to the shift register 44 of the recording head 41, thereby being set in sequence. At that time, most-significant-bit data in the record data SI of the nozzle is serially transferred, and when the serial transfer of the most-significant-bit data is completed, second-higher-order-bit data is then serially transferred. Likewise, the following lower-order-bit data are serially transferred in sequence.

When the record data of the above-described bits of all the nozzles are set into respective elements of the shift register 44, the controller 34 outputs a latch signal LAT to the latch circuit 45 at a fixed timing. The latch circuit 45 latches the record data set in the shift register 44 according to the latch signal LAT. The record data latched by the latch circuit 45 is applied to the level shifter 46 serving as a voltage converter. The level shifter 46 outputs a voltage that can be activated by the switch circuit 47, for example, a voltage of several tens of volts when the record data SI is 1 for example. A signal outputted from the level shifter 46 is applied to the switching element of the switch circuit 47, so that the switching element is brought into a connection mode. To the switching element of the switch circuit 47, the driving signal COM outputted from the driving-signal generating section 36 is supplied; thus, when the switching element of the switch circuit 47 is brought into a connection mode, the driving signal COM is applied to the pressure generating element 48*a* connected to the switching element.

Accordingly, in the recording head 41, whether or not to apply the driving signal COM to the pressure generating element 48*a* can be controlled according to the record data SI. For example, during the period of time in which the record data SI is 1, the switching element of the switch circuit 47 is in a connection mode; thus, the driving signal COM can be supplied to the pressure generating element 48*a*; therefore, the supplied driving signal COM displaces (deforms) the pressure generating element 48*a*. On the other hand, during the period of time in which the record data SI is 0, the switching element of the switch circuit 47 is brought into an unconnected mode, and thus, the supply of the driving signal COM to the pressure generating element 48*a* is blocked. During the period of time in which the record data SI is 0, the pressure generating element 48*a* hold preceding electric charge, thus maintaining the preceding deformation mode. Now, when the switching element of the switch circuit 47 is turned on to apply the driving signal COM to each pressure generating element 48*a*, the pressure generating chamber 48*b* communicating with the nozzle opening 48*c* is contracted to apply pressure to the viscous body in the pressure generating chamber 48*b*, and therefore, the viscous body in the pressure generating chamber 48*b* is discharged as a droplet from the nozzle opening 48*c* to thereby form a dot on the substrate. In this way, droplets are discharged from the droplet discharge unit.

Figure 6:
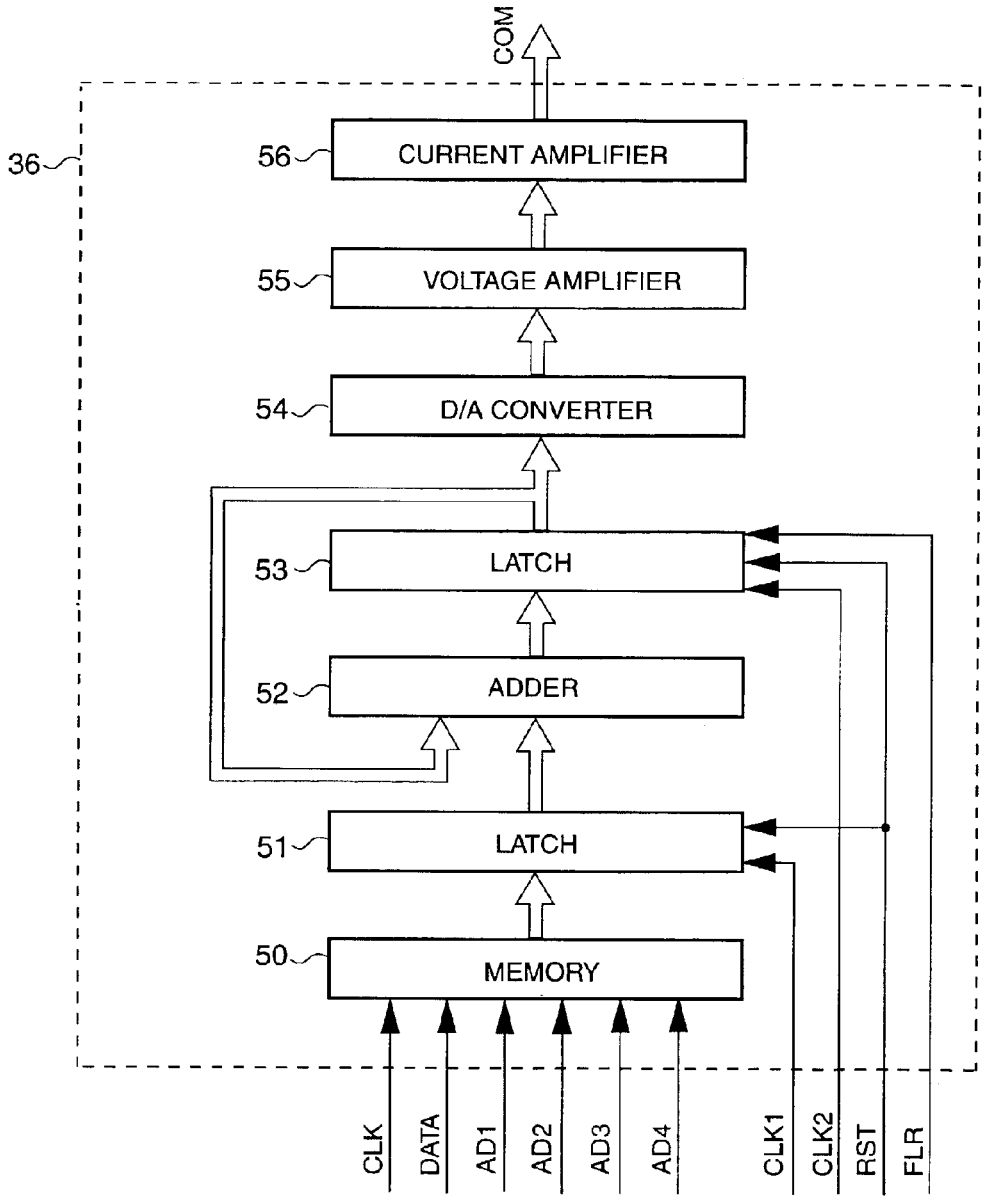
FIG. 6 is an exemplary block diagram showing the arrangement of a driving-signal generating section 36.

The controller 34 and the driving-signal generating section 36 which characterize the present invention will then be described. FIG. 6 is an exemplary block diagram showing the arrangement of the driving-signal generating section 36. The driving-signal generating section 36 shown in FIG. 6 generates the driving signal COM on the basis of various data stored in the data storage section provided in the controller 34. As shown in FIG. 6, the driving-signal generating section 36 has a memory 50 for receiving various signals from the controller 34 and temporarily storing them, a latch 51 for reading the contents of the memory 50 and temporarily storing them, an adder 52 for adding the output from the latch 51 and the output from the other latch 53, a D/A converter 54 for converting the output from the latch 53 to an analog signal, a voltage amplifier 55 for amplifying the analog signal converted by the D/A converter 54 to the voltage of the driving signal COM, and a current amplifier 56 for amplifying the driving signal COM that has been amplified by the voltage amplifier 55. The voltage amplifier 55 and the current amplifier 56 correspond to the supply units in the invention.

A clock signal CLK, a data signal DATA, address signals AD1 to AD4, clock signals CLK1 and CLK2, a reset signal RST, and a floor signal FLR are supplied from the controller 34 to the driving-signal generating section 36. The clock signal CLK has the same frequency (for example, about 10 MHz) as the clock signal CLK outputted from the oscillating circuit 35. The data signal DATA indicates the variation in the voltage of the driving signal COM. The address signals AD1 to AD4 are signals that designate addresses for storing the data signal DATA. When the driving signal COM is generated, a plurality of the data signals DATA indicating the voltage variation are outputted from the controller 34 to the driving-signal generating section 36, thus requiring the address signals AD1 to AD4 to individually store the data signals DATA, which will specifically be described.

The clock signal CLK1 is a signal for specifying the start time and the stop time at which the voltage of the driving signal COM is changed. The clock signal CLK2 is a signal corresponding to the reference clock that specifies the operation timing of the driving-signal generating section 36, and the frequency is set to the same as that of the clock signal CLK. The driving signal COM is generated in synchronization with the clock signal CLK2. The reset signal RST is a signal for making the output of the adder 52 to 0 by initializing the latch 51 and the latch 53 and floor signal FLR is a signal for clearing low-order 8 bits of the latch 53 (the latch 53 has 18 bits) when the voltage of the driving signal COM is changed.

Figure 7:
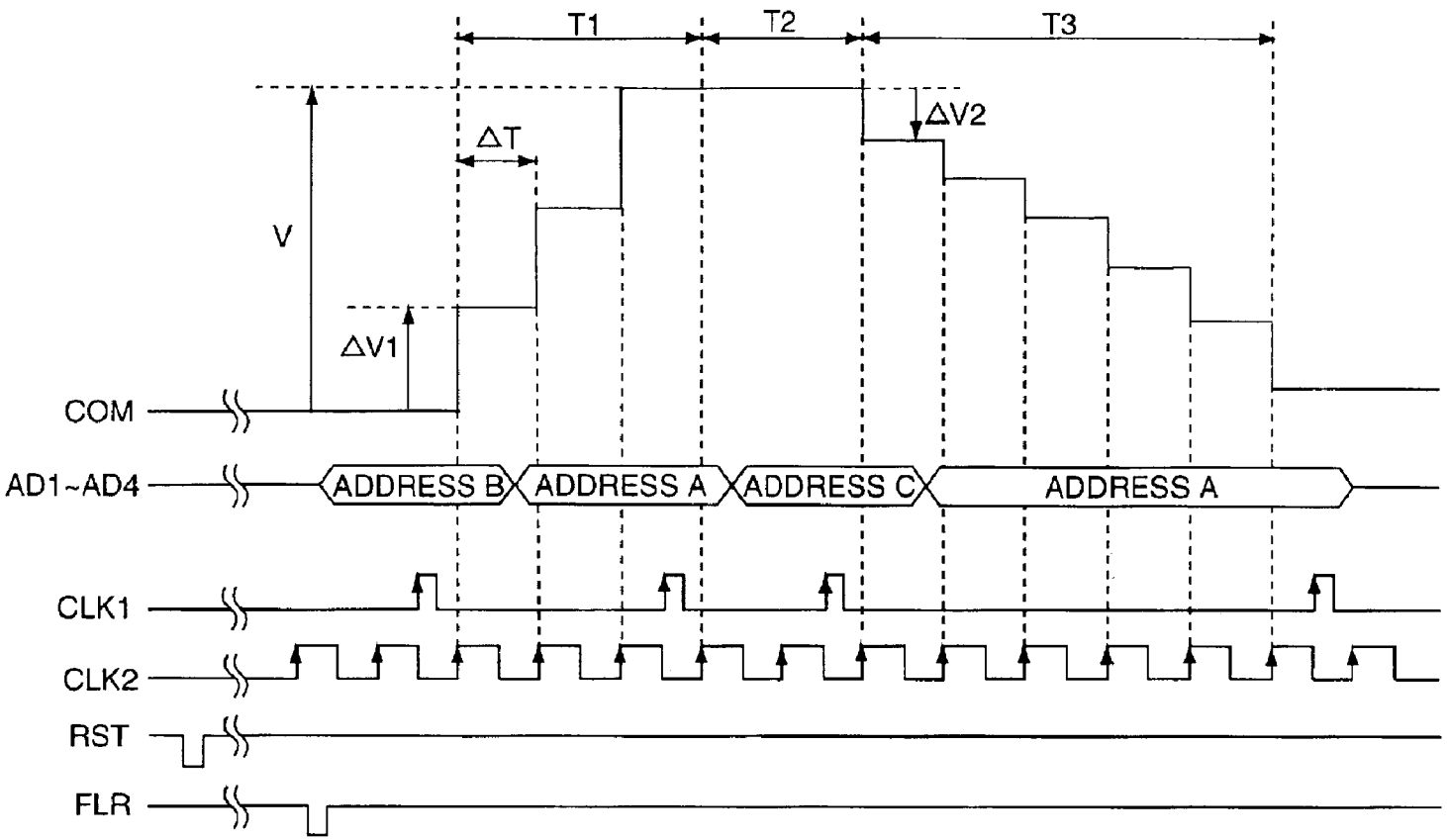
FIG. 7 is a diagram showing an example of the waveform of a driving signal generated by the driving-signal generating section 36.
Figure 8:
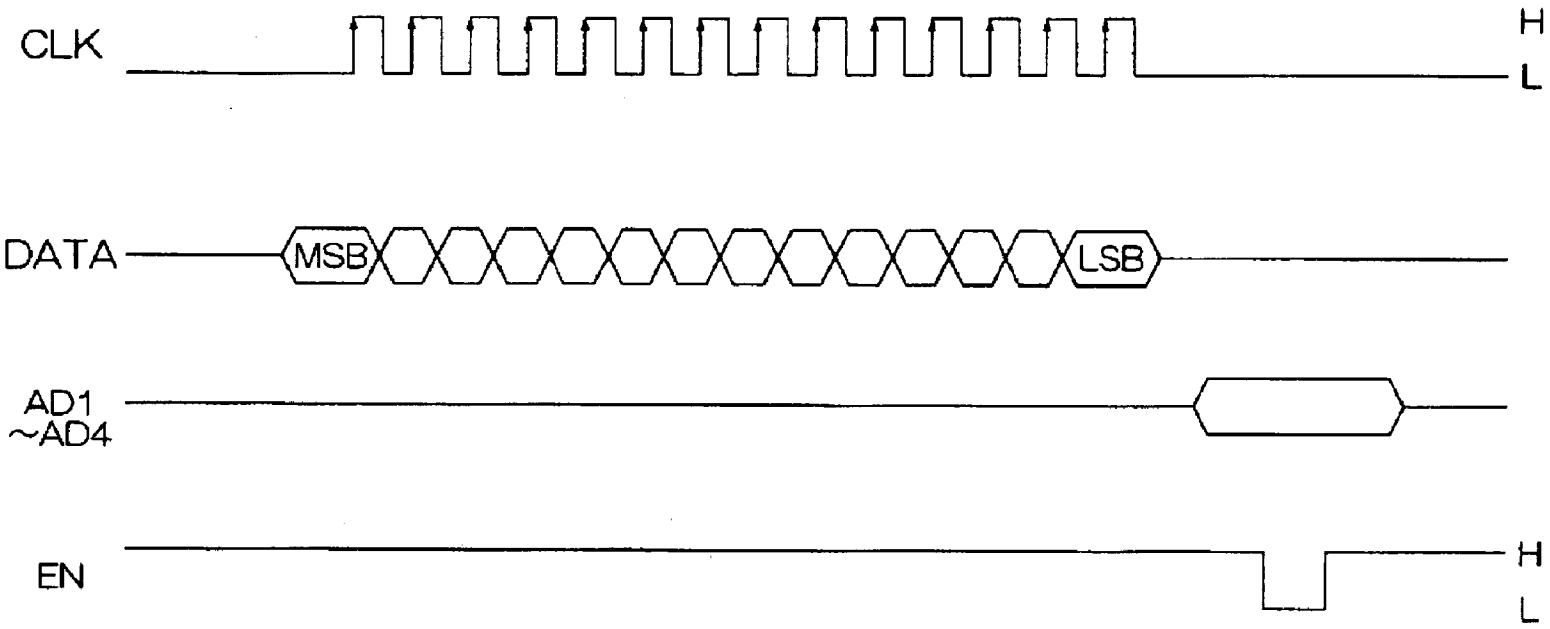
FIG. 8 is a timing chart showing the timings of transferring a data signal DATA and address signals AD1 to AD4 from a controller 34 to the driving-signal generating section 36.

An example of the waveform of the driving signal COM generated by the driving-signal generating section 36 with the above-described arrangement will now be described. FIG. 7 is a diagram showing an example of the waveform of a driving signal generated by the driving-signal generating section 36. As shown in FIG. 7, several data signals DATA indicating the voltage variation and the address signals AD1 to AD4 indicating the addresses of the data signals DATA are outputted from the controller 34 to the driving-signal generating section 36 in synchronization with the clock signal CLK in advance of the generation of the driving signal COM, as shown in FIG. 7. The data signal DATA is serially transferred in synchronization with the clock signal CLK, as shown in FIG. 8. FIG. 8 is a timing chart showing the timings of transferring the data signal DATA and the address signals AD1 to AD4 from the controller 34 to the driving-signal generating section 36.

As shown in FIG. 8, when the data DATA indicating a prescribed voltage variation is transferred from the controller 34, a data signal DATA of a plurality of bits is first outputted in synchronization with the clock signal CLK. Addresses for storing the data signal DATA are then outputted as the address signals AD1 to AD4 in synchronization with an enable signal EN. The memory 50 shown in FIG. 6 reads the address signals AD1 to AD4 at a timing at which the enable signal EN is outputted and writes the received data signal DATA onto the addresses indicated by the address signals AD1 to AD4. Since the address signals AD1 to AD4 have four bits, the data signal DATA indicating the maximum 16 kinds of voltage variations can be stored in the memory 50.

The most significant bit of the data signal DATA is used as a code. The data signal DATA can be stored in the addresses of the memory 50 designated by the address signals AD1 to AD4 by the above-described process. In this case, it is assumed that the data signal is stored in addresses A, B, and C. Furthermore, it is assumed that the reset signal RST and the floor signal FLR are inputted to initialize the latches 51 and 53.

Assuming that the address B is designated by the address signals AD1 to AD4, as shown in FIG. 7 after the setting of the voltage variation to each address A, B, . . . has been completed, a voltage variation that corresponds to the address B is held by the latch 51 in accordance with the clock signal CLK1. When the clock signal CLK2 is then inputted in this state, a value obtained by adding the output of the latch 53 and the output of the latch 51 is held in the latch 53. Once the voltage variation is held by the latch 51, the output of the latch 53 fluctuates with the voltage variation every time the clock signal CLK2 is inputted. The slew rate of the drive waveform is determined depending on a voltage variation ΔV1 stored in the address B of the memory 50 and a cycle ΔT of the clock signal CLK2. Whether it is an increase or a decrease is determined depending on the code of the data stored in each address.

In the example shown in FIG. 7, the address A stores a value 0 as the voltage variation, that is, a value when the voltage is held. Accordingly, when the address A becomes valid by the clock signal CLK1, the waveform of the driving signal COM is held flat without fluctuations. The address C stores a voltage variation ΔV2 for one cycle of the clock signal CLK2 in order to determine the slew rate of the drive waveform. Accordingly, after the address C has become valid by the clock signal CLK1, the voltage is decreased by the voltage variation ΔV2. In this manner, the waveform of the driving signal COM can freely be controlled only by outputting the address signals AD1 to AD4 and the clock signals CLK1 and CLK2 from the controller 34 to the driving-signal generating section 36.

Figure 9:
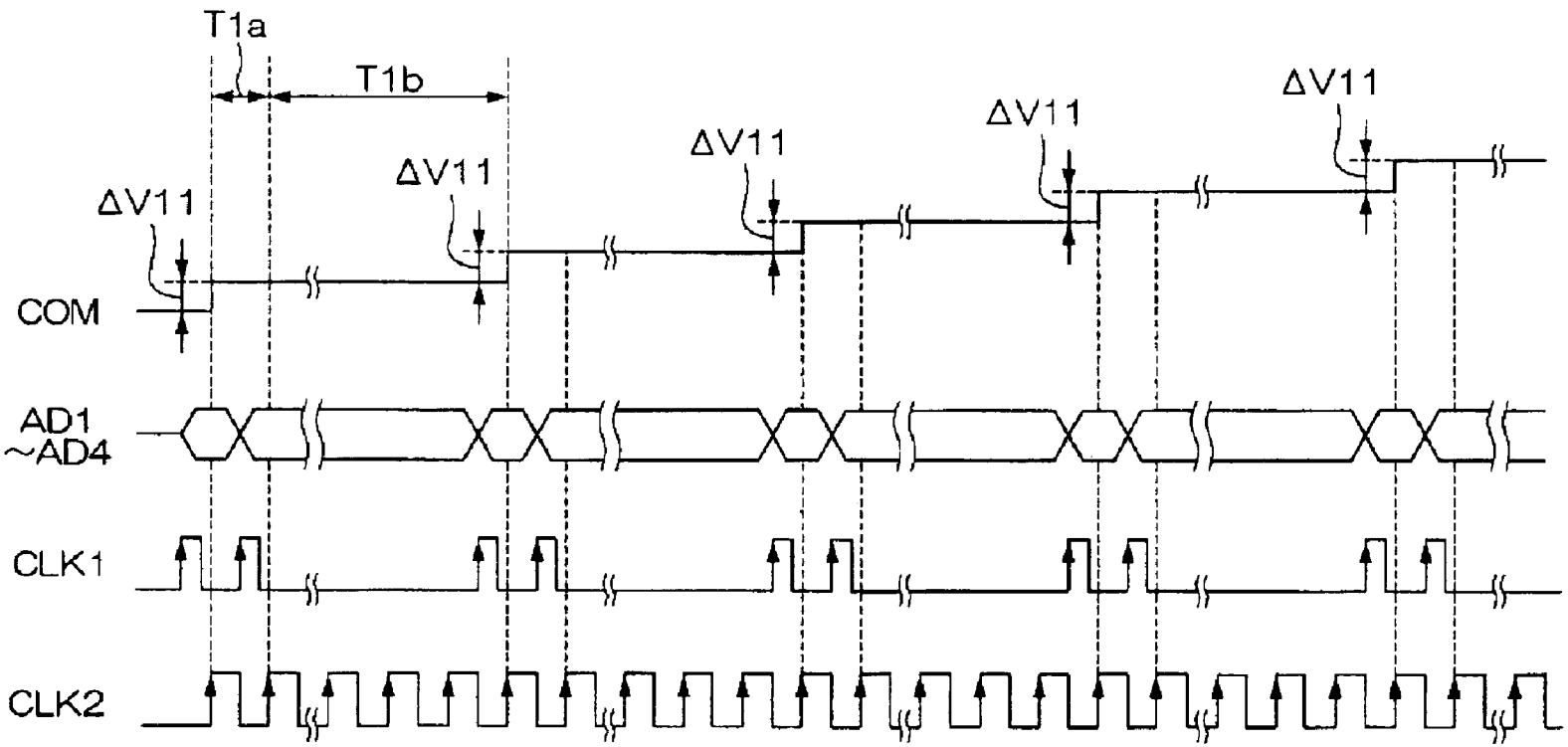
FIG. 9 is a diagram showing an example of a driving signal COM outputted from the driving-signal generating section 36 when the slew rate is set low.

The operation described above is a fundamental operation for controlling the waveform of the driving signal COM. In this embodiment, however, in order to vary the voltage of the driving signal COM (for example, for a rising period T1 or a falling period T3 in FIG. 7), the controller 34 generates the driving signal COM in which the first period during which the value varies and the second period during which the value is held are repeated. FIG. 9 is a diagram showing an example of the driving signal COM outputted from the driving-signal generating section 36 when the slew rate is set low. The example of FIG. 9 illustrates an example of the waveform when the value of the driving signal COM is increased. In FIG. 9, the period T1*a* corresponds to the first period and the period T1*b* corresponds to the second period in the invention.

When the driving signal COM having the waveform shown in FIG. 7 is generated, the waveform is generated in the rising period T1, in which the voltage of the driving signal COM is increased each time the clock signal CLK2 is inputted. In the example shown in FIG. 9, however, the period T1*b* during which the voltage of the driving signal COM is held is provided in the period T1*a* during which the voltage of the driving signal COM is increased by the input of the clock signal CLK2 to thereby decrease the slew rate of the driving signal COM.

The reason why the slew rate of the driving signal COM is decreased is because the viscosity of the droplet discharged form the droplet discharge unit is high, and moreover the amount of the droplet that is discharged at one time may be as much as several μg which is several hundred times as large as that of the conventional units. Therefore, the pressure generating element 48*a* must be deformed slowly in order to discharge a required amount of droplets. For example, the rising period T1, the holding period T2, and the falling period T3, shown in FIG. 7, can be set to 1 sec, 500 ms, and 20 μs, respectively. The durations of the rising period T1, the holding period T2, and the falling period T3 are individually set depending on the viscosity of the viscous body. The viscosity of the viscous body is in the range of, for example, 10 to 40,000 mPa·s at room temperature (25° C.).

The purpose of setting the rising period T1 as long as about one second is to prevent bubbles from entering through the nozzle opening 48*c* because the meniscus gets out of shape owing to high viscosity of the viscous body when the pressure generating element 48*a* is rapidly deformed. While the holding period T11 is set to about one-half (500 ms) of the rising period T1, this is for the purpose of avoiding the effects of the natural frequency of the droplet discharge head 18, which is determined depending on the structure of the droplet discharge head 18. In other words, when the rising period T1 has passed, the natural frequency of the droplet discharge head 18 causes vibration due to the surface tension of the viscous body. The vibration damps with the elapse of time, thus entering a static state. Since it is not preferable to discharge the viscous body while the surface of the viscous body is vibrating, the holding period T2 is set to a sufficient length for the vibration to be stopped. The falling period T3 is set as short as about 20 μs in order to obtain the discharge speed of the viscous body.

In the example shown in FIG. 9, the slew rate of the driving signal COM is determined depending on a voltage variation ΔV11 of the driving signal COM during the period T1*a* and the number of clocks of the clock signal CLK2 held in the period T1*b*, which are set in response to the rate of deformation of the pressure generating element 48*a* per unit time. For example, in order to deform the pressure generating element 48*a* more slowly, the voltage variation ΔV11 is set smaller and the number of clocks of the clock signal CLK2 held in the period T1*b* is set larger. For simplification, suppose the data signal DATA indicating the voltage variation of the driving signal COM is a 10-bit signal without a code. In this case, the voltage variation can take $2^{10}$=1,024 different values, however, it is assumed that the minimum voltage variation is set in order to generate a waveform of slow rising.

In order to generate a waveform in which the time during which the voltage of the driving signal COM varies from the minimum to the maximum is one second, the period T1*a* and the period T1*b* must be repeated 1,024 times because the possible value of the driving signal COM is $2^{10}$. Therefore, the time between the period T1*a* and the period T1*b* is set to 1 sec/1,024=0.976 ms. Here assuming that the frequency of the clock signal CLK2 is 10 MHz, the time of one cycle is 0.1 μs; therefore, the number of clocks of the clock signal CLK2 held in the period T1*b* is set to about 10,000 clocks.

Figure 10:
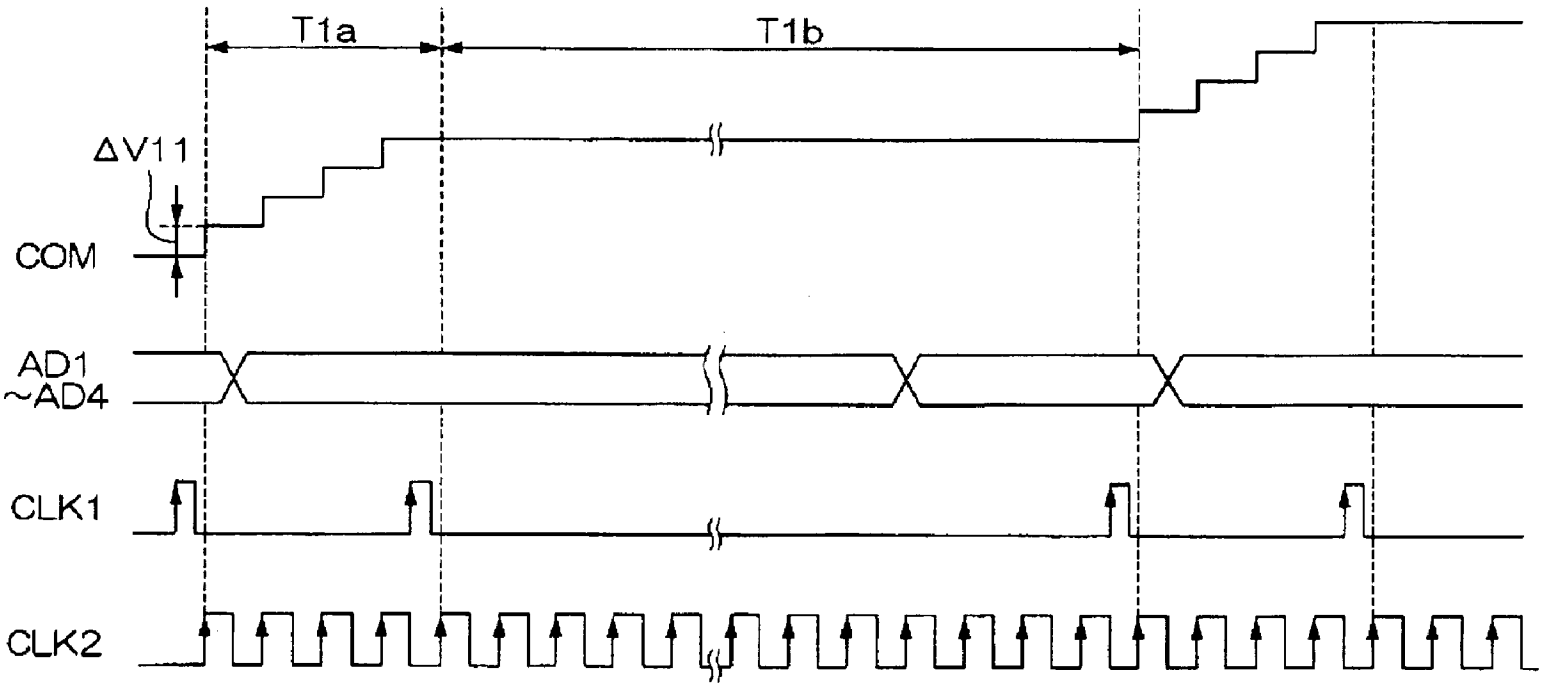
FIG. 10 is a diagram showing an example of the waveform of the driving signal COM when a period T1*a* is set to include a plurality of cycles of a clock signal CLK2.

In the example shown in FIG. 9, although the period T1*a* was set to a time of one cycle of the clock signal CLK2, and the period T2 was set to a time of about 10,000 cycles of the clock signal CLK2, the period T1 a may be set to a time of a plurality of cycles of the clock signal CLK2. FIG. 10 is a diagram showing an example of the waveform of the driving signal COM when the period T1*a* is set to include a plurality of cycles of the clock signal CLK2. Also in FIG. 10, the waveform is an example when the value of the driving signal COM is increased.

In the example of FIG. 10, the period T1*a* is set to a time of four cycles of the clock signal CLK2. Here, in order to generate a waveform in which the time during which the voltage of the driving signal COM varies from the minimum to the maximum is one second, the duration of the period T1*b* is set as four times as the duration set for the period T1*b* shown in FIG. 9. In this manner, the number of times at which the voltage of the driving signal COM is varied during the period T1*a* and the number of clocks of the clock signal CLK2 in which the voltage of the reference signal COM is held are set depending on the rate of deformation of the pressure generating element 48*a* per unit time. The slew rate of the driving signal COM shown in FIG. 9 and the slew rate of the driving signal COM shown in FIG. 10 are the same. The reason why the duration of the period T1*a* is set to a time of a plurality of cycles of the clock signal CLK2, and the voltage of the driving signal COM is changed to a plurality of times of the voltage variation ΔV11 in the period T1*a* is as follows:

Referring again to FIG. 6, the generated driving signal is converted to an analog signal by the D/A converter 54 and the voltage and the current are then amplified by the voltage amplifier 55 and the current amplifier 56, respectively. However, when the voltage of the driving signal is changed by the voltage variation ΔV11 during time 0.1 μm, the voltage amplifier 55 and the current amplifier 56 may not respond. In order to solve the problem, the voltage of the driving signal is increased during a plurality of cycles of the clock signal CLK2, as shown in FIG. 10. Such a control ensures the operation of the voltage amplifier 55 and the current amplifier 56. In this embodiment, as described above, it is preferable to set the number of changes of the voltage of the driving signal COM during the period T1*a* and the number of clocks of the clock signal CLK2 in which the voltage of the reference signal COM is held during the period T1*b* depending on the follow-up performances of the voltage amplifier 55 and the current amplifier 56 as the supply unit for further supplying the driving signal COM to the pressure generating element 48*a*.

Figure 11:
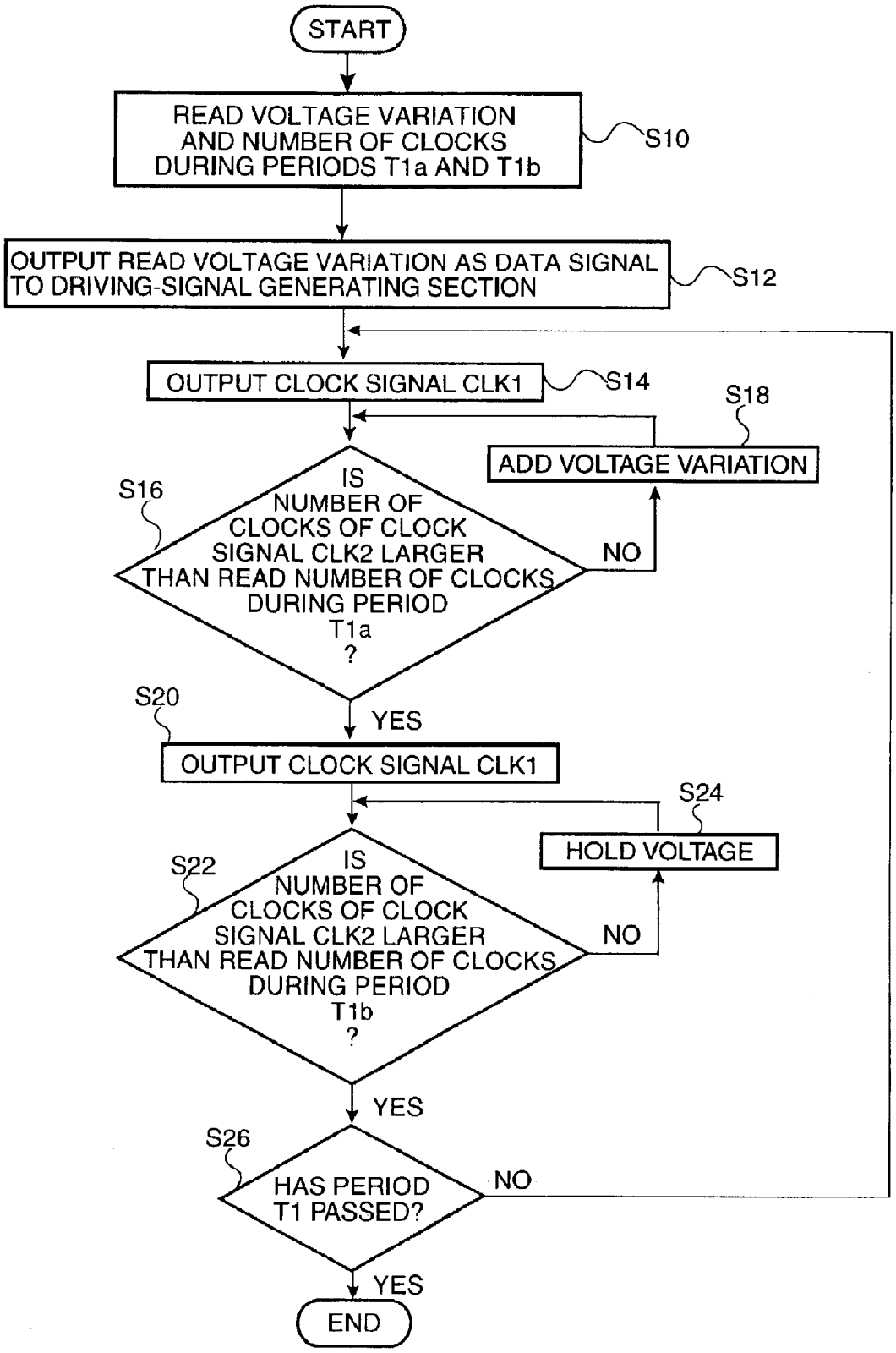
FIG. 11 is a flowchart showing the operations of the controller 34 and the driving-signal generating section 36 when the driving signal having the waveform shown in FIG. 9 or 10 is generated.

FIG. 11 is a flowchart showing exemplary operations of the controller 34 and the driving-signal generating section 36 when the driving signal having the waveform shown in FIG. 9 or 10 is generated. FIG. 11 illustrates only the operation when the waveform during the rising period T1 in FIG. 7 is generated. When the waveform during the rising period T1 in FIG. 7 is generated, it is assumed that the CPU provided in the controller 34 reads out the duration of the period T1 which is previously stored in a data storage section in the controller 34.

The CPU provided in the controller 34 reads out the voltage variation ΔV11 which is previously stored in the data storage section in the control section 34, the number of clocks of the clock signal CLK2 during the period T1*a* and the number of clocks of the clock signal CLK2 during the period T1*b*, shown in FIG. 9 or 10 (step S10). Subsequently, the CPU provided in the controller 34 outputs the read voltage variation to the driving-signal generating section 36 through a data signal (step S12). When the data signal is outputted to the driving-signal generating section 36, it is stored into the memory 50 in the driving-signal generating section 36, as described with reference to FIG. 8. When the foregoing processes are completed, the clock signal CLK1 is outputted from the controller 34 to the driving-signal generating section 36 (step S14).

The data signal (a signal indicating the voltage variation ΔV11) stored in the memory 50 is latched by the latch 51 in accordance with the clock signal CLK1. Subsequently, after outputting the clock signal CLK1, the controller 34 determines whether the number of clocks of the clock signal CLK2 outputted to the driving-signal generating section 36 is more than the number of clocks during the period T1*a*, which was read in step S10 (step S16). When the determination is NO, the voltage variation is added by the adder 52 of the driving-signal generating section 36 and the voltage of the driving signal COM increases in synchronization with the clock signal CLK2 (step S18). Supposing the driving signal having the waveform shown in FIG. 10 is set to be generated, the processes in steps S16 and S18 are repeated four times. The step S18 corresponds to the first step in the invention.

On the other hand, when the determination in step S16 is YES, the clock signal CLK1 is outputted from the controller 34 to the driving-signal generating section 36 (step S20). When the clock signal CLK1 is inputted, a signal indicating a value 0 is latched into the latch 51. After outputting the clock signal CLK1 by the process in step S20, the controller 34 determines whether the number of the clocks of the clock signal CLK2 outputted to the driving-signal generating section 36 is more than the number of clocks during the period T1*b*, which was read in step S10 (step S22). When the determination is NO, the voltage of the driving signal COM is held because the signal indicating a value 0 is latched in the latch 51 (step S24).

If a setting is made to generate a driving signal having the waveform shown in FIG. 9, the processes in steps S12 and S24 are repeated about 10,000 times. The step S24 corresponds to the second step in the invention. When the determination in step S22 is YES, it is determined whether the period T1 has passed (step S16). When the determination is NO, the process returns to step S14 and the foregoing processes are repeated. On the other hand, when the determination in step S26 is YES, the process of generating the waveform during the period T1 is completed.

While a head driving method according to an embodiment of the invention was described, it was described for the case of generating a driving signal COM consists of the rising period T1, the holding period T2, and the falling period T3, shown in FIG. 7. It should be understood that the head drive unit and the method thereof are not limited to the case of generating the driving signal COM consisting of the above-described three periods, but may be applied to a case of generating a driving signal COM having a waveform shown in FIG. 12.

Figure 12:
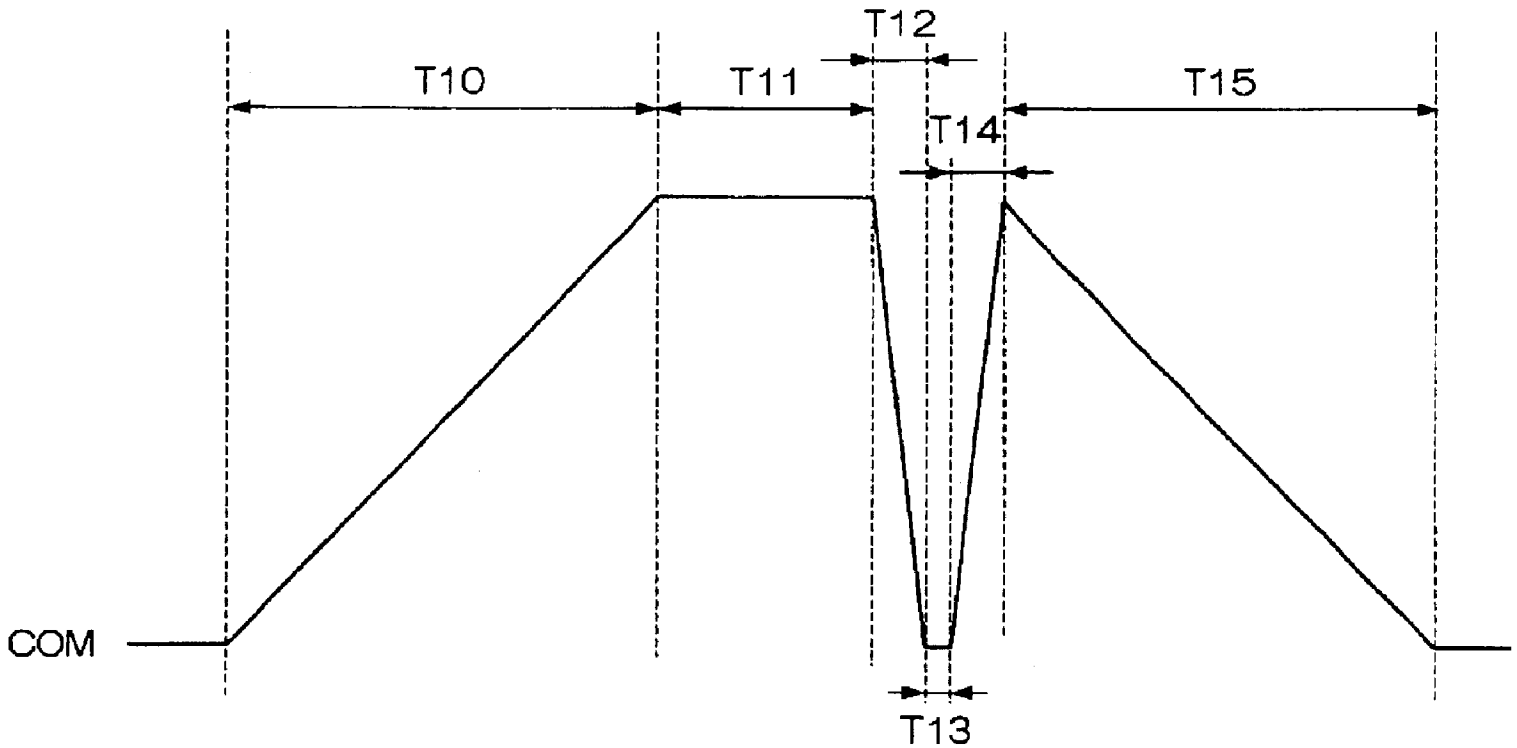
FIG. 12 is a diagram showing the waveform of the driving signal COM in consideration of the satellite of a droplet and the meniscus of a viscous body after the droplet has been discharged.

FIG. 12 is a diagram showing the waveform of the driving signal COM in consideration of the satellite of a droplet and the meniscus of a viscous body after the droplet has been discharged. For discharging high-viscous droplet, for example, after the pressure generating element 48*a* has gradually been deformed to take the viscous body into the droplet discharge head 18, the pressure generating element 48*a* must be rapidly deformed (restored) to obtain a certain extent of discharge speed of the droplet. Therefore, a period T10 for deforming the pressure generating element 48*a* is set long (about one second) and a period T12 for recovering is set short (about 20 μs).

Figure 13A:
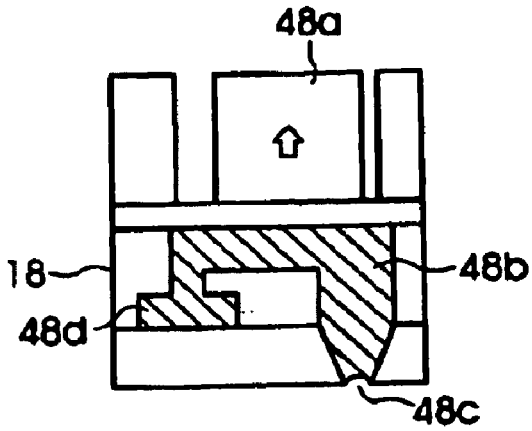
FIGS. 13(*a*)–13(*c*) are diagrams for explaining the droplet discharge operation of a droplet discharge head 18 when the driving signal COM having the waveform of the periods T10 to T13, shown in FIG. 12, is applied.
Figure 13B:
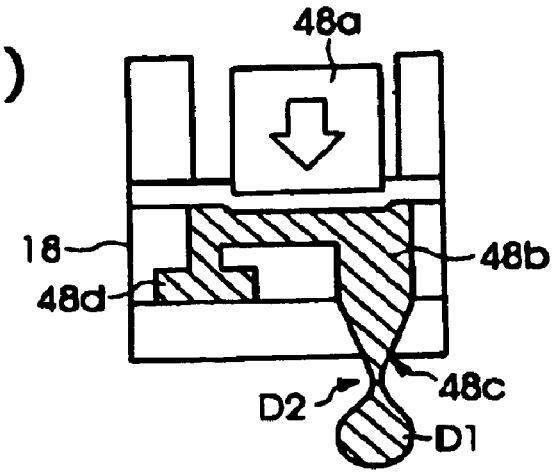
Figure 13C:
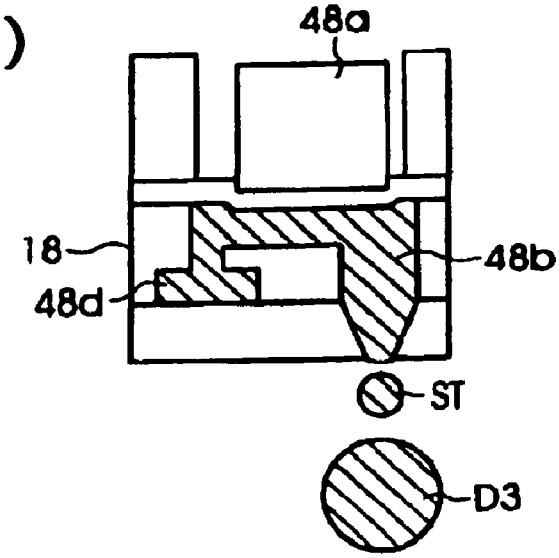
Figure 14A:
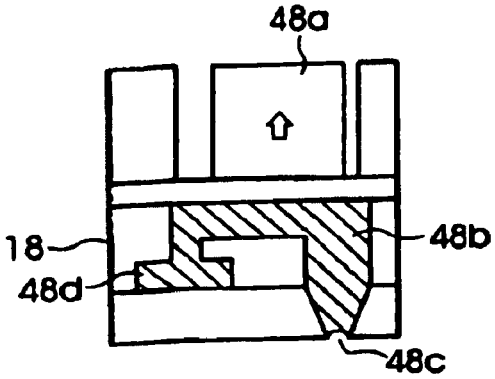
FIGS. 14(*a*)–14(*d*) are diagrams for explaining the droplet discharge operation of the droplet discharge head 18 when the driving signal COM having an aftercare period is applied.
Figure 14C:
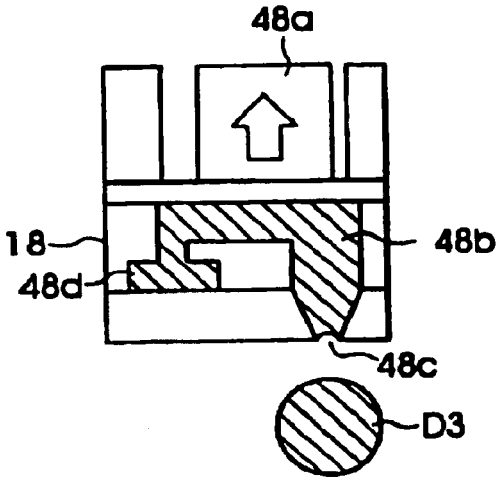
Figure 14B:
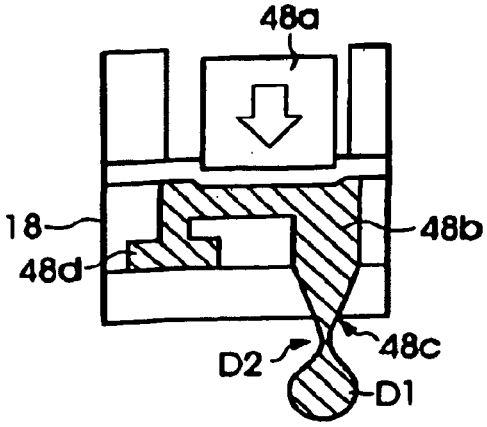
Figure 14D:
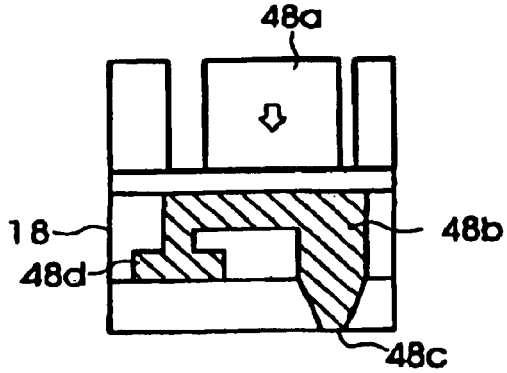

The droplet discharge operation of the droplet discharge head 18 when the driving signal COM having a waveform of periods T10 to T13, shown in FIG. 12, is applied will now be described. FIG. 13 is a diagram for explaining the droplet discharge operation of the droplet discharge head 18 when the driving signal COM having the waveform of the periods T10 to T13, shown in FIG. 12, is applied. When the voltage of the driving signal COM is gradually increased during the period T10, the pressure generating element 48*a* provided to the droplet discharge head 18 is gradually deformed, as shown in FIG. 13(*a*), so that the viscous body is supplied from a viscous body chamber 48*d* to the pressure generating chamber 48*b*, and also the viscous body near the nozzle opening 48*c* is slightly taken into the pressure generating chamber 48*b*, as shown in the drawing.

When the pressure generating element 48*a* is rapidly deformed (restored) at about 20 μs during the period T12 after the voltage of the driving signal COM has been held for a fixed period of time (for example, 500 ms) during the period T11, a droplet D1 is discharged from the nozzle opening 48*c*, as shown in FIG. 13(*b*). Unless the voltage of the driving signal COM is changed after the elapse of the period T12, part of the tail D2 of the droplet D1, shown in FIG. 13(*b*), is separated to form a satellite ST in addition to the original droplet D3, as shown in FIG. 13(*c*) because the viscous body has high viscosity. Since the satellite ST may scatter in different directions from the droplet D3, it may dirty a land surface when the droplet D3 is landed. When the driving signal having the waveform of the periods T10 to T12, shown in FIG. 12, is intermittently applied to the pressure generating element 48*a* to discharge droplets continuously at fixed intervals, the meniscus at the nozzle opening 48*c* gets out of shape because of high viscosity of the viscous body, thus causing an undesirable situation for discharging droplets.

In order to prevent such problems, periods T14 and T15 (aftercare periods) for deforming the pressure generating element 48*a* by a fixed amount are provided after the waveform of the periods T10 to T12 in FIG. 12. The driving signal during the periods T14 and T15 corresponds to an auxiliary driving signal in the invention. The aftercare periods are provided after the period T12, that is, after the period T13 which is set to, for example, about 10 μs. Here, the aftercare period T14 is set to about 20 μs and the period T15 is set to about one second. The purpose of setting the period T14 as short as about 20 μs is to prevent the satellite ST by rapidly deforming the pressure generating element 48*a* to thereby take back part of the droplet that was discharged from the nozzle opening 48*c* once. The purpose of setting the period T15 as long as about one second is not to make the meniscus get out of shape.

The operation will be described with reference to FIG. 14. FIG. 14 is a diagram for explaining the droplet discharge operation of the droplet discharge head 18 when the driving signal COM having the aftercare period is applied. First, during the period T10 in FIG. 12, the voltage of the driving signal COM is gradually increased, the pressure generating element 48*a* provided to the droplet discharge head 18 is gradually deformed, as shown in FIG. 14(*a*), so that the viscous body is supplied from the viscous body chamber 48*d* to the pressure generating chamber 48*b*, and also the viscous body near the nozzle opening 48*c* is slightly taken into the pressure generating chamber 48*b*, as shown in the drawing.

When the pressure generating element 48*a* is rapidly deformed (restored) for about 20 μs during the period T12 after the voltage of the driving signal COM has been held for a fixed period of time (for example, 500 ms) during the period T11, the droplet D1 is discharged from the nozzle opening 48*c*, as shown in FIG. 14(*b*). When the driving signal COM having the waveform, shown in the drawing, is applied to the pressure generating element 48*a* during the period T14 through the period T13 after the elapse of the period T12, the pressure generating element 48*a* is deformed as shown in FIG. 14(*c*), and part of the droplet D1 discharged from the nozzle opening 48*c* (the tail D2 shown in FIG. 14(*b*)) is taken into the nozzle opening 48*c*. In this way, the tail D2 causing the generation of the satellite ST is taken into the nozzle opening 48*c* to prevent the generation of the satellite.

As described above, the generation of the satellite can be prevented by the waveform of the period T14. However, since the pressure generating element 48*a* is deformed during the period T14, the surface of the viscous body is taken into the nozzle opening 48*c*, as shown in FIG. 14(*c*), to make the meniscus get out of shape slightly. In order to correct the poor shape, the pressure generating element 48*a* is gradually deformed (restored) during the period T15 to maintain the meniscus in a fixed state (refer to FIG. 14(*d*)).

For activating the droplet discharge head 10 in accordance with the driving signal COM having the aftercare period, the pressure generating element 48*a* must be gradually deformed or recovered during the periods T10 and T15, and the pressure generating element 48*a* must be rapidly deformed or recovered also during the periods T12 and T14. Even when the driving signal COM having a waveform of a low slew rate and a high slew rate in part is generated, this embodiment can ready for it merely by setting the voltage variation during the period T1*a*, the number of clocks of the clock signal CLK2 during the period T1*a*, and the number of clocks of the clock signal CLK2 during the period T1*b* depending on the slew rate appropriately. The waveform of the driving signal COM can also be set arbitrarily in consideration of the state of the surface of the viscous body and the satellite.

Figure 15:
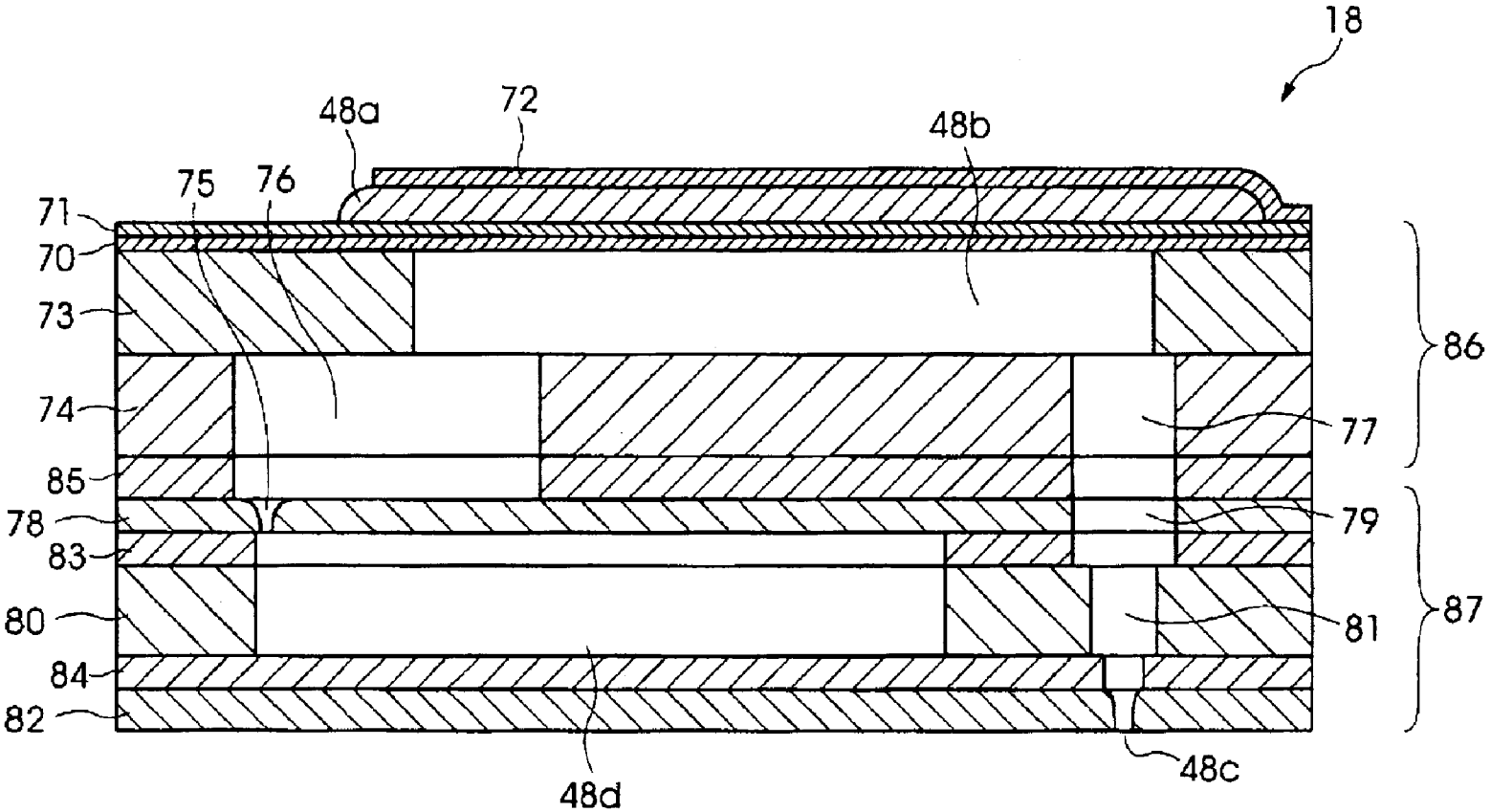
FIG. 15 is a diagram showing an example of the mechanical sectional structure of the droplet discharge head 18.

The foregoing description was made about a simplified structure of the droplet discharge head 18, however, the following description is about the specific structure of the droplet discharge head 18. FIG. 15 is a diagram showing an example of the mechanical sectional structure of the droplet discharge head 18. In FIG. 15, a first lid member 70 is formed of a thin plate of zirconia (ZrO) having a thickness of about 6 μm, on the surface of which a common electrode 71 serving as one electrode is formed. Onto the surface of the common electrode 71, the pressure generating element 48*a* made of PZT (lead zirconate titanate) or the like is fixed, as will be described later, and the surface of the pressure generating element 48*a* has a driving electrode 72 formed of a relatively soft metal layer made of Au (gold) or the like.

The pressure generating element 48*a* can include a flexural oscillation actuator together with the first lid member 70. When electrically charged, the pressure generating element 48*a* contracts to be deformed, thereby reducing the volume of the pressure generating chamber 48*b*, and when electrically discharged, the pressure generating element 48*a* expands to be deformed in the direction to expand the volume of the pressure generating chamber 48*b* as before. A spacer 73 is formed such that a through hole is made in a ceramic plate made of zirconia or the like having a thickness of, for example, about 100 μm. Both sides of the spacer 73 are sealed by the first lid member 70 and a second lid member 74, which will be described later, to form the pressure generating chamber 48*b*.

The second lid member 74 is formed of a ceramic plate made of zirconia or the like, as is the first lid member 70. The second lid member 74 has a through hole 76 for connecting the pressure generating chamber 48*b* to a viscous-body supply port 75, which will be described later, and a nozzle through hole 77 for connecting the other end of the pressure generating chamber 48*b* the nozzle opening 48*c*, and is fixed to the other side of the spacer 73. The first lid member 70, the spacer 73, and the second lid member 74 are integrated into an actuator unit 86 without an adhesive by forming a viscous ceramic material into a fixed shape and baking it in layers.

A viscous-body-supply-port forming substrate 78 has the viscous-body supply port 75 and the through hole 79, serving as a fixing substrate for the actuator unit 86. A viscous-body-chamber forming substrate 80 has a through hole serving as a viscous body chamber, and a through hole 81 connected to a through hole 79 formed in the viscous-body-supply-port forming substrate 78. A nozzle plate 82 has the nozzle opening 48*c* for discharging the viscous body. The viscous-body-supply-port forming substrate 78, the viscous-body-chamber forming substrate 80, and the nozzle plate 82 are fixed by adhesive layers 83 and 84 made of a heat deposition film or an adhesive, thus being integrated into a channel unit 87. The channel unit 87 and the actuator unit 86 are fixed by an adhesive layer 85 made of a heat deposition film or an adhesive to form the droplet discharge head 18.

In the droplet discharge head 18 having the above structure, when the pressure generating element 48*a* is electrically discharged, the pressure generating chamber 48*b* expands to decrease the pressure therein, and thus, the viscous body flows into the pressure generating chamber 48*b* from the viscous body chamber 48*d*. On the other hand, when the pressure generating element 48*a* is electrically charged, the pressure generating chamber 48*b* contracts to thereby increase the pressure in the pressure generating chamber 48*b*, and thus, the viscous body in the pressure generating chamber 48*b* is discharged to the exterior as a droplet through the nozzle opening 48*c*.

Figure 16:
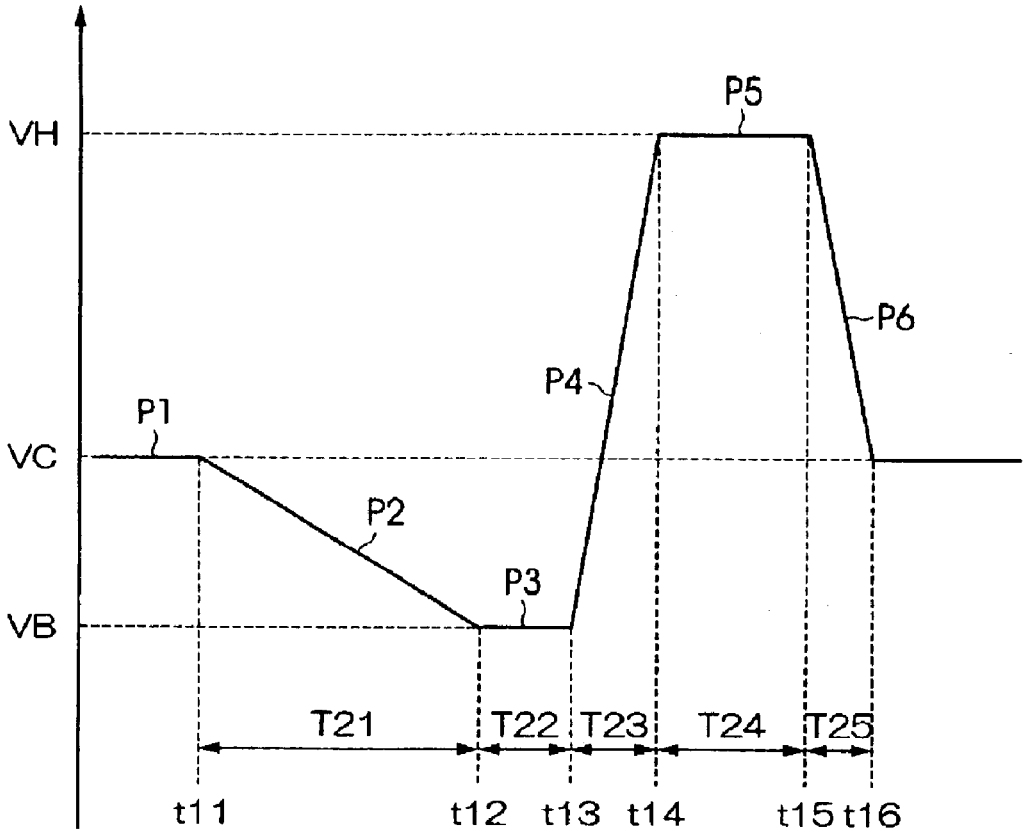
FIG. 16 is a diagram showing the waveform of the driving signal COM which is applied to a droplet discharge head with the arrangement of FIG. 15.

FIG. 16 is a diagram showing the waveform of the driving signal COM which is supplied to the droplet discharge head with the arrangement of FIG. 15. In FIG. 16, the driving signal COM for activating the pressure generating element 48*a* holds an intermediate potential VC for a fixed period of time until time t11 (a hold pulse P1), and then decreases the voltage to the minimum potential VB at a fixed gradient during a period T21 from time t11 to time t12 (a discharge pulse P2). During the period T21, the process shown in FIG. 11 is performed to thereby generate a driving signal with a waveform having the period T2 b for holding the voltage of the driving signal COM during the period T1*a* for changing the voltage of the driving signal COM.

After the minimum potential VB has been held during a period T22 from time t12 to time t13 (a hold pulse P3), it is increased to the maximum potential VH at a fixed gradient during a period T23 from time t13 to time t14 (a charge pulse P4), and the maximum potential VH is held for a fixed period of time until time 15 (a hold pulse P5); thereafter, it is again decreased to the intermediate potential VC during a period T25 until time t16 (a discharge pulse P6).

When such a driving signal COM is applied to the droplet discharge head shown in FIG. 15, the meniscus of the viscous body after the droplet has been discharged by the discharge pulse which has been applied before causes vibration around the nozzle opening 48*c* by a fixed cycle of vibration due to the surface tension of the viscous body while the hold pulse P1 is applied, and the meniscus damps the vibration with time into a static state. When the discharge pulse P2 is then applied, the pressure generating element 48*a* is deformed in the direction to increase the volume of the pressure generating chamber 48*b*, thereby generating a negative pressure in the pressure generating chamber 48*b*. As a result, the meniscus causes a motion toward the inside of the nozzle opening 48*c* and is taken into the nozzle opening 48*c*.

When the charge pulse P4 is applied after the hold pulse P3 has been applied and held in this state, the pressure generating chamber 48*b* generates a positive pressure to force the meniscus out of the nozzle opening 48*c*, thereby discharging a droplet. Thereafter, when the discharge pulse P6 is applied, the pressure generating element 48*a* is deformed in the direction to increase the volume of the pressure generating chamber 48*b*, thereby generating a negative pressure in the pressure generating chamber 48*b*. As a result, the meniscus causes a motion toward the inside of the nozzle opening 48*c*. The meniscus causes vibration around the nozzle opening 48*c* by a fixed cycle of vibration due to the surface tension of the viscous body, and then damps the vibration with time into a static state again. While the waveform of the driving signal to be supplied to the droplet discharge head shown in FIG. 15 was described above, it is preferable to provide the aftercare periods shown in FIG. 12 and to thereby generate a waveform in response to the viscosity of the viscous body and the response characteristic of the droplet discharge head, in order to maintain the meniscus in a fixed state and to prevent the satellite.

Figure 17:
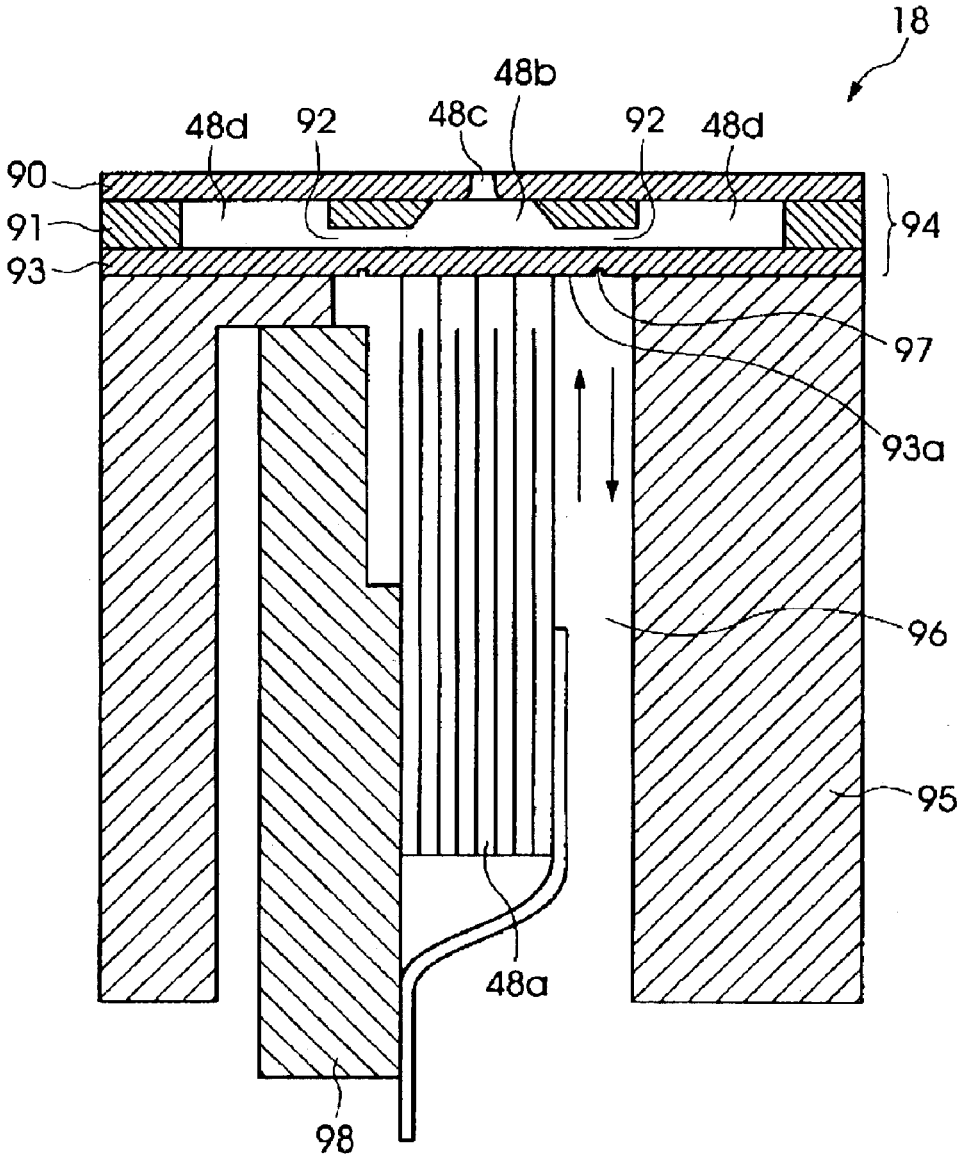
FIG. 17 is a diagram showing another example of the mechanical sectional structure of the droplet discharge head 18.

FIG. 17 is a diagram showing another example of the mechanical sectional structure of the droplet discharge head 18. FIG. 17 illustrates an example of the mechanical sectional structure of the recording head 41 that uses a contraction-vibrating piezoelectric oscillator as a pressure generating element. In the droplet discharge head 18 shown in FIG. 17, reference numeral 90 denotes a nozzle plate and reference numeral 91 designates a channel forming plate. The nozzle plate 90 has the nozzle opening 48*c* and the channel forming plate 91 has a through hole that partitions the pressure generating chamber 48*b*, a through hole or a groove that partitions two viscous-body supply ports 92 communicating with the pressure generating chamber 48*b* at both sides, and a through hole that partitions two common viscous body chambers 48*d* communicating with the respective viscous-body supply ports 92.

The vibrating plate 93 is formed of a thin plate that can elastically be deformed, is in contact with the end of the pressure generating element 48*a* such as a piezo-element, and is integrated with the nozzle plate 90 liquid-tightly while sandwiching the channel forming plate 91 therebetween to form a channel unit 94. A base 95 has a holding chamber 96 for holding the pressure generating element 48*a* such that it can vibrate, and an opening 97 which supports the channel unit 94, the base 95 fixing the pressure generating element 48*a* with a fixing substrate 98, with the end of the pressure generating element 48*a* exposed from the opening 97. The base 95 fixes the channel unit 94 to the opening 97 with an island section 93*a* of the vibrating plate 93 in contact with the pressure generating element 48*a*, thereby being combined into the droplet discharge head.

Figure 18:
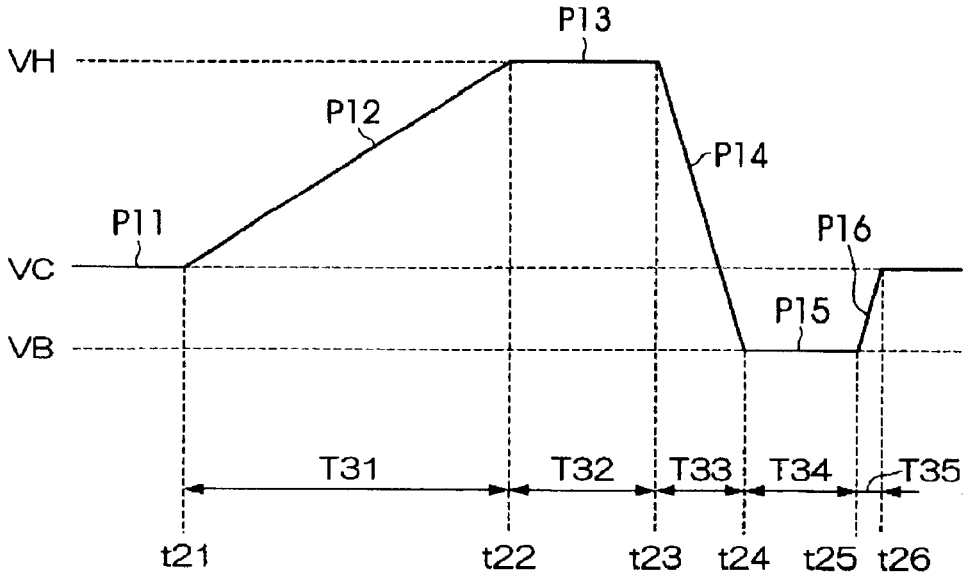
FIG. 18 is a diagram showing the waveform of the driving signal COM which is applied to a droplet discharge head with the arrangement of FIG. 17.

FIG. 18 is a diagram showing an exemplary waveform of the driving signal COM which is applied to a droplet discharge head with the arrangement of FIG. 17. In FIG. 18, the voltage of the driving signal COM for activating the pressure generating element 48*a* increases to the maximum potential VH at a fixed gradient (a charge pulse P12) during a period T31 from time t21 to time t22 after it has started at an intermediate potential VC (a hold pulse P11). The process shown in FIG. 11 is performed during the period T31, thereby generating a driving signal with a waveform having the period T2 b of holding the voltage of the driving signal COM during the period T1*a* in which the voltage of the driving signal COM is varied.

After the maximum electricity VH has been held during a period T32 from time t22 to time t23 (a hold pulse P13), it is decreased to the minimum potential VB at a fixed gradient during a period T33 from time t23 to time t24 (a discharge pulse P14); thereafter, the minimum potential VB is held for a predetermined period of time during a period T34 from time t24 to time t25 (a hold pulse P15). The voltage is increased at a fixed gradient to the intermediate potential VC from time t25 to time t26 (a charge pulse P16).

In the recording head 41 with such an arrangement, when the charge pulse P12 held in the driving signal COM is applied to the pressure generating element 48*a*, the pressure generating element 48*a* is deflected in the direction that expands the volume of the pressure generating chamber 48*b* to generate a negative pressure in the pressure generating chamber 48*b*. Consequently, the meniscus is taken into the nozzle opening 48*c*. When the discharge pulse P14 is then applied, the pressure generating element 48*a* is deflected in the direction that contracts the volume of the pressure generating chamber 48*b* to generate a positive pressure in the pressure generating chamber 48*b*. Consequently, a droplet is discharged from the nozzle opening 48*c*. After the hold pulse P15 has been applied, the charge pulse P16 is applied to damp the vibration of the meniscus. The waveform of the driving signal to be supplied to the droplet discharge head shown in FIG. 17 was described, however, it is preferable to provide the driving signal to be supplied to the droplet discharge head having this structure with the aftercare periods, shown in FIG. 12, thereby generating a waveform in response to the viscosity of the viscous body and the response characteristic of the droplet discharge head, in order to hold the meniscus in a fixed state and to prevent the satellite.

In the head drive method according to this embodiment described above, all or part of the program for realizing the method may be stored in a recording medium that a computer can read, such as a flexible disk, a CD-ROM, a CD-R, a CD-RW, a DVD (a registered trademark), a DVD-R, a DVD-RW, a DVD-RAM, a magneto-optical disk, a streamer, a hard disk, and a memory.

According to the head drive unit and the method of this embodiment, as described above, when the waveform of the driving signal COM during the rising period and the falling period is generated, the controller 34 and the driving-signal generating section 36 generate the driving signal COM having the period T1*b* of holding the voltage between the periods T1*a* of varying the voltage. Therefore, the rate of change in the voltage of the driving signal COM per unit time can appropriately be set depending on the voltage variation ΔV11 during the period T1*a*, the number of clocks of the clock signal CLK2 held in the period T1*a*, and the number of clocks of the clock signal CLK2 held in the period T1*b*. Accordingly, the pressure generating element 48*a* provided to the droplet discharge head 18 can be deformed or restored slowly over several seconds or in as short time as a few hundred nanoseconds.

When a high viscosity body is discharged, it must be taken into the droplet discharge head 18 (pressure generating chamber 48*b*) and then the droplet must be discharged at a certain speed. In this embodiment, since the pressure generating element 48*a* can be deformed or restored slowly over several seconds or in as short time as a few hundred nanoseconds, as described above, it is remarkably preferable for discharging a high viscosity body.

In this embodiment, since the rate of change in the voltage of the driving signal COM per unit time is set depending on the voltage variation ΔV11 during the period T1*a*, the number of clocks of the clock signal CLK2 held in the period T1*a*, and the number of clocks of the clock signal CLK2 held in the period T1*b*, the shape of the applicable waveform is not particularly limited. Therefore, the meniscus can preferably be held during the droplet discharging operation, and the waveform for preventing the generation of the satellite which may cause contamination can also be formed easily. Consequently, a fixed amount of viscous body can be discharged constantly and accurately.

Furthermore, in this embodiment, in order to vary the rate of change in the voltage of the driving signal COM per unit time, the voltage variation ΔV11 during the period T1*a*, the number of clocks of the clock signal CLK2 held in the period T1*a*, and the number of clocks of the clock signal CLK2 held in the period T1*b* are set as appropriate. Such an arrangement can be achieved merely by the change of software without substantial changes of the unit arrangement, thus being realized by existing equipment with almost no new manufacturing equipment. Using the conventional equipment allows effective use of resources. Furthermore, the device manufacturing method of this embodiment employs a structure in which the devices are manufactured by the process using the droplet discharge units 3, 7, and 11. Such an arrangement can flexibly be ready for changes in the product specifications, thus allowing the manufacture of devices with various ranges of specifications.

Having described the invention as related to the embodiment of the present invention, it is to be understood that the invention be not limited to such an embodiment but may be varied broadly within the spirit and scope of the present invention. As an example of the foregoing embodiment, a device manufacturing apparatus was described which has the droplet discharge unit 3 for landing a red (R) droplet, the droplet discharge unit 7 for landing a green (G) droplet, and the droplet discharge unit 11 for landing a blue (B) droplet separately, wherein a single-color droplet is discharged from each of the droplet discharge heads 18 of the droplet discharge units 3, 7, and 11, as shown in FIG. 1.

The invention, however, can also be applied to a combination of the droplet discharge head for landing a red droplet, the droplet discharge head for landing a green droplet, and the droplet discharge head for landing a blue droplet. Also, application of the droplet discharge patterning technique of this apparatus to a metallic material or an insulating material allows direct fine patterning for a metallic wiring, an insulating film and so on, thus leading to application to manufacturing of new high-performance devices.

The device manufacturing apparatus having the droplet discharge unit of this embodiment performs a patterning for R (red) first, a patterning for G (green) second, and a patterning B (blue) finally, however, it is not limited to that but may perform patterning in other orders, as necessary. In the foregoing embodiment, a high viscosity body was used as an example of a viscous body, however, the invention is not limited to discharge of the viscous body but may be applied to discharge of viscous liquids or resins. Also, in the foregoing embodiment, while a case in which a piezoelectric oscillator was used as a pressure generating element provided to the droplet discharge head was described, the invention can also be applied to a droplet discharge unit having a droplet discharge head that generates pressure in a pressure generating chamber by heating.

What is claimed is:

1. A head drive unit that discharges a viscous body by operating in synchronization with a reference clock to apply a driving signal to a pressure generating element of a head, and thereby deform the pressure generating element, the head drive unit comprising:

a driving-signal generating device that generates a driving signal in which a first period during which a value varies in synchronization with the reference clock and a second period during which the value is held during a plurality of cycles of the reference clock are repeated during a single deformation of the pressure generating element.

2. A head drive unit that discharges a viscous body by operating in synchronization with a reference clock to apply a driving signal to a pressure generating element of a head, and thereby deform the pressure generating element, the head drive unit comprising:

a driving-signal generating device that generates a driving signal in which a first period during which a value varies in synchronization with the reference clock and a second period during which the value is held during a plurality of cycles of the reference clock are repeated when deforming the pressure generating element, wherein the rate of change in the value during the first period and the number of cycles of the reference clock in which the value is held during the second period being set based on the rate of deformation of the pressure generating element per unit time.

3. A head drive unit that discharges a viscous body by operating in synchronization with a reference clock to apply a driving signal to a pressure generating element of a head, and thereby deform the pressure generating element, the head drive unit comprising:

a driving-signal generating device that generates a driving signal in which a first period during which a value varies in synchronization with the reference clock and a second period during which the value is held during a plurality of cycles of the reference clock are repeated when deforming the pressure generating element, wherein the number of changes of the value in synchronization with the reference clock during the first period and the number of cycles of the reference clock in which the value is held during the second period being set based on the rate of deformation of the pressure generating element per unit time.

4. The head drive unit according to claim 3, the pressure generating element having a supply unit that supplies the pressure generating element with the driving signal, and the number of changes of the value in synchronization with the reference clock during the first period and the number of cycles of the reference clock in which the value is held during the second period being further set in accordance with a following performance of the supply unit for the driving signal.

5. A head drive unit that discharges a viscous body by operating in synchronization with a reference clock to apply a driving signal to a pressure generating element of a head, and thereby deform the pressure generating element, the head chive unit comprising:

a driving-signal generating device that generates a driving signal in which a first period during which a value varies in synchronization with the reference clock and a second period during which the value is held during a plurality of cycles of the reference clock are repeated when deforming the pressure generating element, wherein the rate of deformation of the pressure generating element per unit time being set depending on a viscosity of the viscous body.

6. The head drive unit according to claim 1, a viscosity of the viscous body being in the range of 10 to 40,000 mPa·s at room temperature (25° C.).

7. The head drive unit according to claim 1, the pressure generating element including a piezoelectric oscillator that pressurizes the viscous body by at least one of contraction-vibration and deformation-vibration by the application of the driving signal.

8. A droplet discharge unit comprising the head drive unit according to claim 1.

9. A device manufactured by using the droplet discharge unit according to claim 8.

10. A head drive method of a head drive unit that discharges a viscous body by operating in synchronization with a reference clock to apply a driving signal to a pressure generating element of a head, and thereby deforming the pressure generating element, wherein, during a single deformation of the pressure generating element, the head drive method repeats:

a first step of varying a value of the driving signal in synchronization with the reference clock; and a second step of holding the value of the driving signal during a plurality of cycles of the reference clock.

11. A head drive method of a head drive unit that discharges a viscous body by operating in synchronization with a reference clock to apply a driving signal to a pressure generating element of a head, and thereby deforming the pressure generating element, wherein, when deforming the pressure generating element, the head drive method repeats:

a first step of varying a value of the driving signal in synchronization with the reference clock; and a second step of holding the value of the driving signal during a plurality of cycles of the reference clock, wherein the rate of change in the value in the first step and the number of cycles of the reference clock in which the value is held in the second step being set based on the rate of deformation of the pressure generating element per unit time.

12. A head drive method of a head drive unit that discharges a viscous body by operating in synchronization with a reference clock to apply a driving signal to a pressure generating element of a head, and thereby deforming the pressure generating element, wherein, when deforming the pressure generating element, the head drive method repeats:

a first step of varying a value of the driving signal in synchronization with the reference clock; and a second step of holding the value of the driving signal during a plurality of cycles of the reference clock, wherein the number of changes of the value in synchronization with the reference clock in the first step and the number of cycles of the reference clock in which the value is held in the second step being set based on the rate of deformation of the pressure generating element per unit time.

13. The head drive method according to claim 12, the number of changes of the value in synchronization with the reference clock in the first step and the number of cycles of the reference clock in which the value is held in the second step being further set in accordance with a following performance of the supply unit that supplies the pressure generating element with the driving signal, for the driving signal.

14. A head drive method of a head drive unit that discharges a viscous body by operating in synchronization with a reference clock to apply a driving signal to a pressure generating element of a head, and thereby deforming the pressure generating element, wherein, when deforming the pressure generating element, the head drive method repeats:

a first step of varying a value of the driving signal in synchronization with the reference clock; and a second step of holding the value of the driving signal during a plurality of cycles of the reference clock, wherein a rate of deformation of the pressure generating element per unit time being set based on a viscosity of the viscous body.

15. The head drive method according to claim 10, the viscosity of the viscous body being in the range of 10 to 40,000 mPa·s at room temperature (25° C.).

16. A program for performing the head drive method according to claim 10.

17. A device manufacturing apparatus comprising a head drive that performs a process of discharging the viscous body by the head drive method according to claim 10.

18. A device manufactured by using the device manufacturing apparatus according to claim 17.

19. A head drive unit that discharges a viscous body by operating in synchronization with a reference clock to apply a driving signal to a pressure generating element of a head, and thereby deform the pressure generating element, the head drive unit comprising:

a driving-signal generating device that generates a driving signal in which a first period during which a value varies in synchronization with the reference clock and a second period during which the value is held during a plurality of cycles of the reference clock are repeated when deforming the pressure generating element, wherein the first and second repeated periods allow the driving signal gradient to be varied.

20. A head drive method of a head drive unit that discharges a viscous body by operating in synchronization with a reference clock to apply a driving signal to a pressure generating element of a head, and thereby deforming the pressure generating element, wherein, when deforming the pressure generating element, the head drive method repeats:

a first step of varying a value of the driving signal in synchronization with the reference clock; and a second step of holding the value of the driving signal during a plurality of cycles of the reference clock, wherein the first and second repeated steps allow the driving signal gradient to be varied.

21. A head drive unit that discharges a viscous body by operating in synchronization with a reference clock to apply a driving signal to a pressure generating element of a head, and thereby deform the pressure generating element, the head drive unit comprising:

a driving-signal generating device that generates a driving signal in which a first period during which a value varies in synchronization with the reference clock and a second period during which the value is held during a plurality of cycles of the reference clock are repeated when deforming the pressure generating element, wherein the first and second repeated periods vary the driving signal at a predetermined rate to a predetermined voltage.

22. A head drive method of a head drive unit that discharges a viscous body by operating in synchronization with a reference clock to apply a driving signal to a pressure generating element of a head, and thereby deforming the pressure generating element, wherein, when deforming the pressure generating element, the head drive method repeats:

a first step of varying a value of the driving signal in synchronization with the reference clock; and a second step of holding the value of the driving signal during a plurality of cycles of the reference clock, wherein the first and second repeated steps vary the driving signal at a predetermined rate to a predetermined voltage.

* * * * *